US006510821B2

(12) United States Patent
Fujimoto et al.

(10) Patent No.: US 6,510,821 B2
(45) Date of Patent: Jan. 28, 2003

(54) INTERNAL COMBUSTION ENGINE WITH VARIABLE COMPRESSION RATIO MECHANISM

(75) Inventors: Hiroya Fujimoto, Kanagawa (JP); Katsuya Moteki, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/906,674

(22) Filed: Jul. 18, 2001

(65) Prior Publication Data

US 2002/0020368 A1 Feb. 21, 2002

(30) Foreign Application Priority Data

Jul. 31, 2000 (JP) ..... 2000-230232

(51) Int. Cl.[7] ..... F02B 75/04
(52) U.S. Cl. ..... 123/48 B; 123/78 F
(58) Field of Search ..... 123/48 B, 78 F, 123/197.4, 78 R, 78 A, 78 AA, 78 B, 78 BA

(56) References Cited

U.S. PATENT DOCUMENTS 4,517,931 A * 5/1985 Nelson ..... 123/48 B
4,955,328 A * 9/1990 Sobotowski ..... 123/51 R
5,152,262 A * 10/1992 Parker ..... 123/90.17
5,967,123 A * 10/1999 Ruoff et al. ..... 123/495
6,390,035 B2 * 5/2002 Moteki et al. ..... 123/78 BA

FOREIGN PATENT DOCUMENTS

JP 9-228858 9/1997

* cited by examiner

*Primary Examiner*—Willis R. Wolfe
*Assistant Examiner*—Mahmoud Gimie
(74) *Attorney, Agent, or Firm*—Foley & Lardner

(57) ABSTRACT

An internal combustion engine is constructed to include a variable compression ratio mechanism. The mechanism has the following structure. An upper link has one end pivotally connected to a piston pin of a piston of the engine. A lower link is pivotally disposed on a crank pin of a crankshaft of the engine and has one part pivotally connected to the other end of the upper link. A control shaft extends substantially in parallel with the crankshaft. A control link has an end pivotally connected to the other part of the lower link. The other end of the control link is connected to the control shaft through an eccentric bearing structure, so that rotation of the control shaft about its axis induces a pivoting of the lower link about the crank pin varying the stroke of the piston.

23 Claims, 33 Drawing Sheets

INTERNAL COMBUSTION ENGINE WITH VARIABLE COMPRESSION RATIO MECHANISM

BACKGROUND OF THE INVENTION

1. Field of the Invention

The present invention relates in general to internal combustion engines having a variable compression ratio mechanism by which the compression ratio of the engine can be varied, and more particularly to internal combustion engines having the variable compression ratio mechanism of a double-link type.

2. Description of the Prior Art

In order to clarify the task of the present invention, one known internal combustion engine of the above-mentioned type will be briefly described with reference to FIG. 42 of the accompanying drawings, which is shown in a paper "MTZ Motortechnische Zeitschrift 58" issued in 1997 in Germany.

As shown in the drawing, the engine having a variable compression ratio mechanism incorporated therewith is of a four cylinder type.

The mechanism comprises four upper links 2 each having one end pivotally connected to a piston pin 1*a* of a corresponding piston 1, four lower links 4 each being pivotally disposed on a crank pin of a crankshaft 3 and having one end pivotally connected to the corresponding upper link 2, a control shaft 5 extending in parallel with the crankshaft 3 and four control links 6 each having one end pivotally connected to the corresponding upper link 2 and the other end pivotally connected to the control shaft 5 through an eccentric cam 5*a*. When the control shaft 5 is rotated about its axis to an angular position, the fulcrum of each control link 6 is changed and thus the actual distance between the piston pin 1*a* and the corresponding crank pin of the crankshaft 3 is varied changing the stroke of the piston 1. Due to change of the piston stroke, the compression ratio of the engine can be varied.

SUMMARY OF THE INVENTION

However, due to its inherent construction, the variable compression ratio mechanism of the above-mentioned type has failed to provide the engine with a compact construction. That is, provision of the control shaft 5, which is positioned away from the crankshaft 3 in a lateral direction of the engine, causes a largely expanded structure of one side wall of a cylinder block of the engine.

It is therefore an object of the present invention to provide an internal combustion engine with a compact variable compression ratio mechanism.

It is another object of the present invention to provide a variable compression ratio mechanism which can be compactly installed in an internal combustion engine.

According to the present invention, there is provided an internal combustion engine which comprises a cylinder block having a cylinder in which a piston reciprocates; a crankshaft rotatably installed in the cylinder block and including a crank pin and a counter-weight; and a variable compression ratio mechanism including an upper link having one end pivotally connected to a piston pin of the piston, a lower link pivotally disposed on the crank pin of the crankshaft and having one part pivotally connected to the other end of the upper link, a control shaft extending substantially in parallel with the crankshaft, a control link having a first end pivotally connected to the other part of the lower link and an eccentric bearing structure through which a second end of the control link is connected to the control shaft, so that rotation of the control shaft about its axis induces a pivoting of the lower link about said crank pin thereby to vary the stroke of the piston.

DETAILED DESCRIPTION OF EMBODIMENTS

In the following, various embodiments of the present invention will be described in detail with reference to the accompanying drawings. For ease of understanding, similar or substantially same parts are designated by the same numerals and repeated explanation of such parts will be omitted throughout the description.

Furthermore, for ease of understanding, various dimensional terms, such as, right, left, upper, lower, rightward, upward and the like are used in the description. However, such terms are to be understood with respect to only a drawing on which the corresponding part or portion is shown.

Referring to FIGS. 1 to 4, there is shown an internal combustion engine with a variable compression ratio mechanism, which is a first embodiment of the present invention.

The engine having the variable compression ratio mechanism incorporated therewith is of a four cylinder type.

Figure 1:
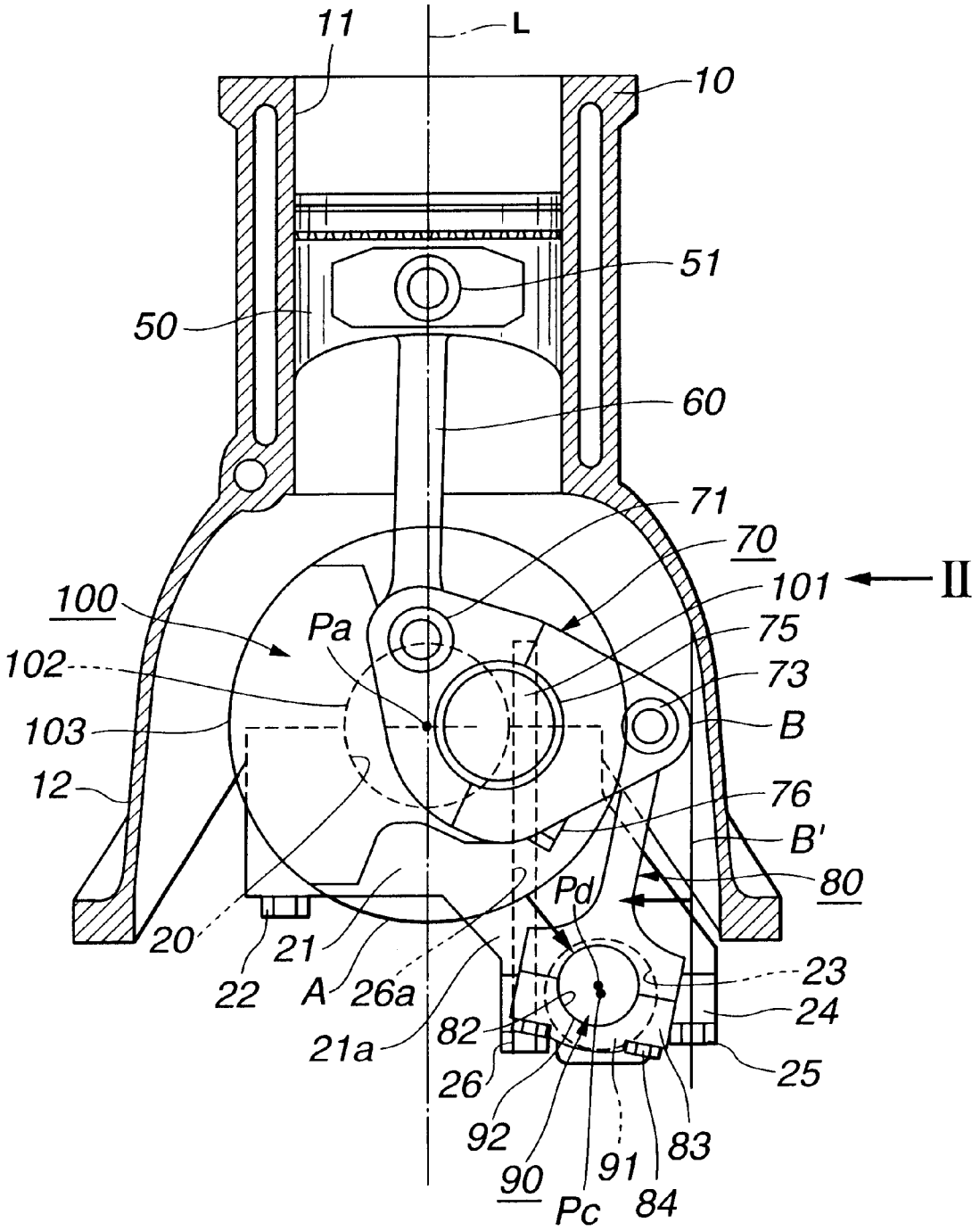
FIG. 1 is a sectional view of an internal combustion engine with a variable compression ratio mechanism, which is a first embodiment of the present invention.
Figure 2:
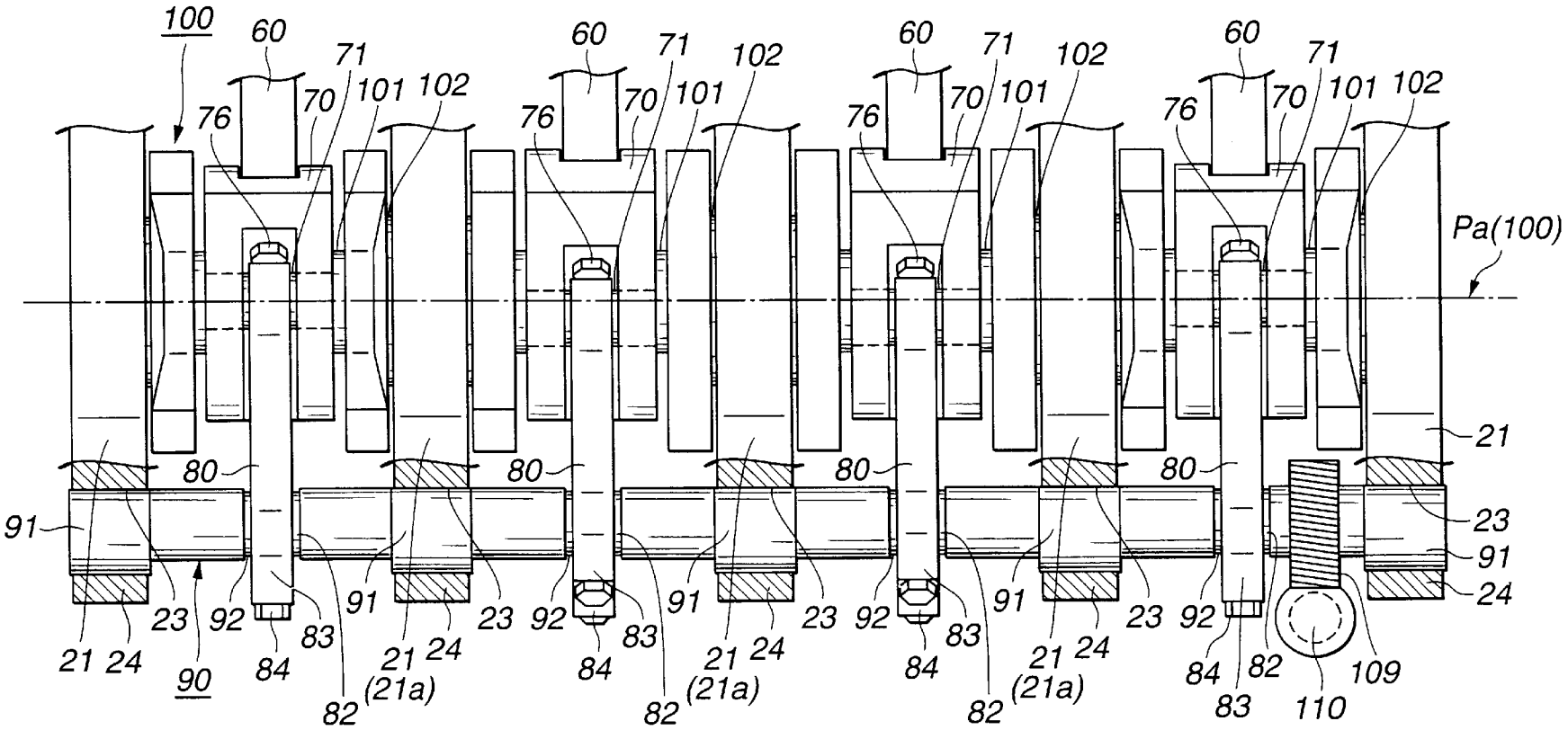
FIG. 2 is a partially cut side view of the internal combustion engine of first embodiment, which is taken from the direction of an arrow "II" of FIG. 1.

As is well seen from FIGS. 1 and 2, the variable compression ratio mechanism comprises four upper links 60 each having one end pivotally connected to a piston pin 51 of a corresponding piston 50, four lower links 70 each being pivotally disposed on a crank pin 101 of a crankshaft 100 and having one end pivotally connected through an upper link pin 71 to the other end of the corresponding upper link 60, a control shaft 90 located at a right lower side of the crankshaft 100 (in FIG. 1) and extending in parallel with the crankshaft 100 and four control links 80 each having a lower end pivotally connected, through an aftermentioned eccentric bearing structure, to the control shaft 90 and an upper end pivotally connected through a control link pin 73 to the corresponding lower link 70. As shown, the lower link 70 is in a triangular shape and has at a generally middle portion a circular opening through which the crank pin 101 passes. One corner of the lower link 70 is pivotally connected to the lower end of the upper link 60, and other corner of the lower link 70 is pivotally connected to the upper end of the control link 80.

Figure 4:
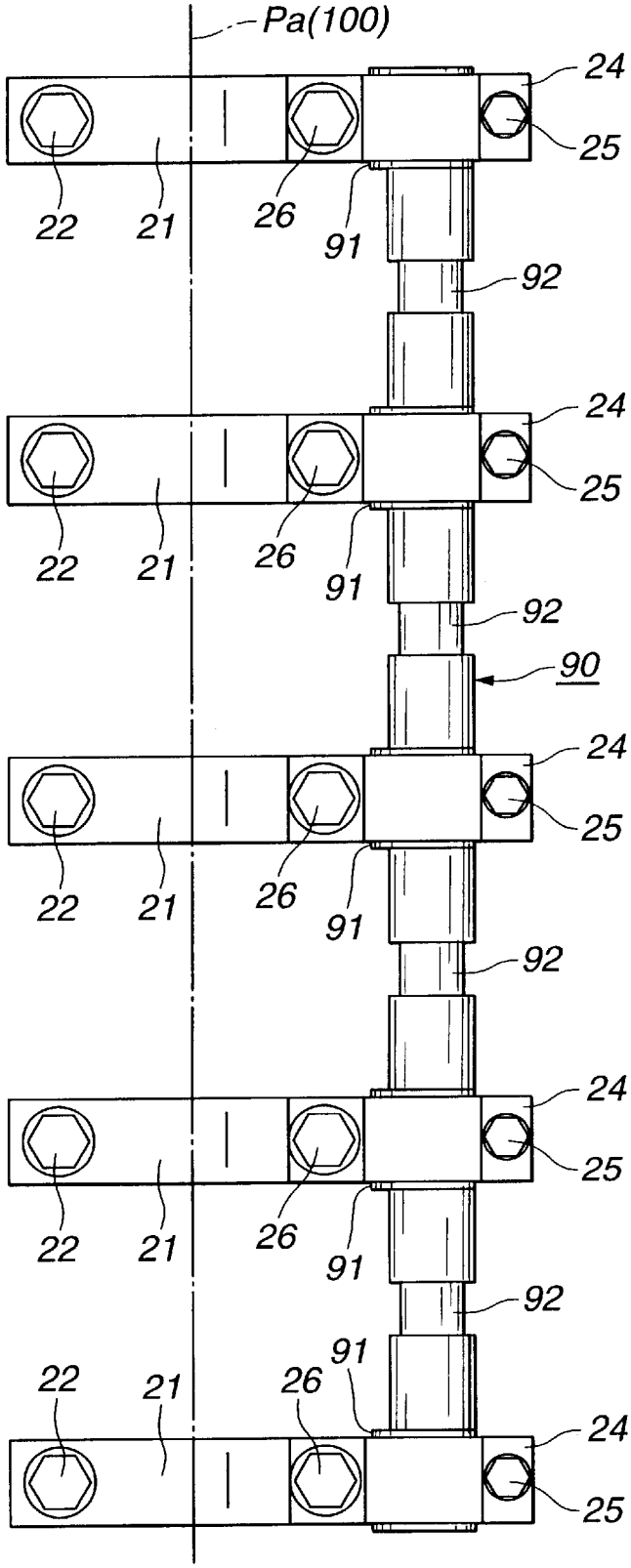
FIG. 4 is a bottom view of the variable compression ratio mechanism associated with the engine of the first embodiment.

As is seen from FIGS. 2 and 4, the control shaft 90 is formed with four axially spaced pin journals 92 each being rotatably held by a bearing portion 82 (see FIG. 1) provided by the corresponding control link 80.

As is seen from FIG. 1, a rotation center "Pd" of each pin journal 92 is eccentric to a rotation center "Pc" of the control shaft 90, so that each control link 80 is swung relative to the control shaft 90 using the corresponding rotation center "Pc" as a swing fulcrum. That is, the lower end of each control link 80 is pivotally connected to the control shaft 90 through a so-called eccentric bearing structure.

Upon rotation of the control shaft 90 to a certain angular position, the rotation center "Pd" of each pin journal 92 changes its angular position relative to the rotation center "Pc" of the control shaft 90 and thus the distance between the corresponding crank pin 101 and the corresponding piston pin 51 is changed causing a change of the stroke of the piston 50 and thus inducing a change of the compression ratio of the corresponding cylinder.

As is seen from FIG. 2, the control shaft 90 has at a right end portion a worm wheel 109 disposed thereon, which is meshed with a worm 110 driven by an electric motor (not shown) which is controlled by a control unit (not shown) in accordance with an operation condition of the engine.

As is seen from FIGS. 1 and 2, the bearing portion 82 of each control link 80, by which corresponding pin journal 92 of the control shaft 90 is rotatably held, has a split structure so as to facilitate the work for assembling the control link 80 to the control shaft 90. That is, each bearing portion 82 comprises a rounded recess which is formed in the control link 80 and a rounded recess which is formed on a bearing cap 83 detachably connected to the control link 80 through connecting bolts 84. Similar to this, a bearing portion 75 of each lower link 70, by which the crank pin 101 of the crankshaft 100 is rotatably held, has a split structure to facilitate the work for assembling the lower link 70 to the crank pin 101. As is seen from FIGS. 1 and 2, connecting bolts 76 are used for connecting two parts of the bearing portion 75.

Denoted by numeral 103 in FIG. 1 is a counter-weight provided by the crankshaft 100 for smoothing rotation of the crankshaft 100.

In the first embodiment of the present invention, the following constructional feature is provided, which will be described in detail with the aid of FIGS. 1 and 3.

In FIG. 1, denoted by reference "L" is an imaginary reference line which extends along an axis of the cylinder 11 and through a rotation axis "Pa" of the crankshaft 100. Denoted by reference "B" is a position (viz., most remote position) taken by an outermost part of the lower link 70 close to the link pin 73 when the link pin 73 assumes the most remote position from the reference line "L" in the same side as the rotation center "Pc" with respect to the reference line "L" during each operation cycle of the engine. Denoted by reference "A" is a locus described by the outer periphery of the counter-weight 103.

When, in the first embodiment, the outermost part of the lower link 70 close to the link pin 73 assumes the above-mentioned most remote position "B", the rotation center "Pc" of the control shaft 90 is positioned outside of the locus "A" of the counter-weight 103 and positioned nearer to the reference line "L" than the most remote position "B" is. That is, the distance between the reference line "L" and the rotation center "Pc" of the control shaft 90 is smaller than that between the reference line "L" and a most remote line "B'" which extends through the most remote position "B" along the axis of the cylinder 11.

In other words, as is seen from FIG. 1, the rotation center "Pc" of the control shaft 90 is positioned at an obliquely low position relative to the rotation center "Pa" of the crankshaft 100. That is, the control shaft 90 and its associated parts are positioned away from the crankshaft 100 in an obliquely downward direction. More specifically, the control shaft 90 and its associated parts are located in a so-called dead space defined near a lower end of a skirt section 12 of a cylinder block 10.

Figure 42:
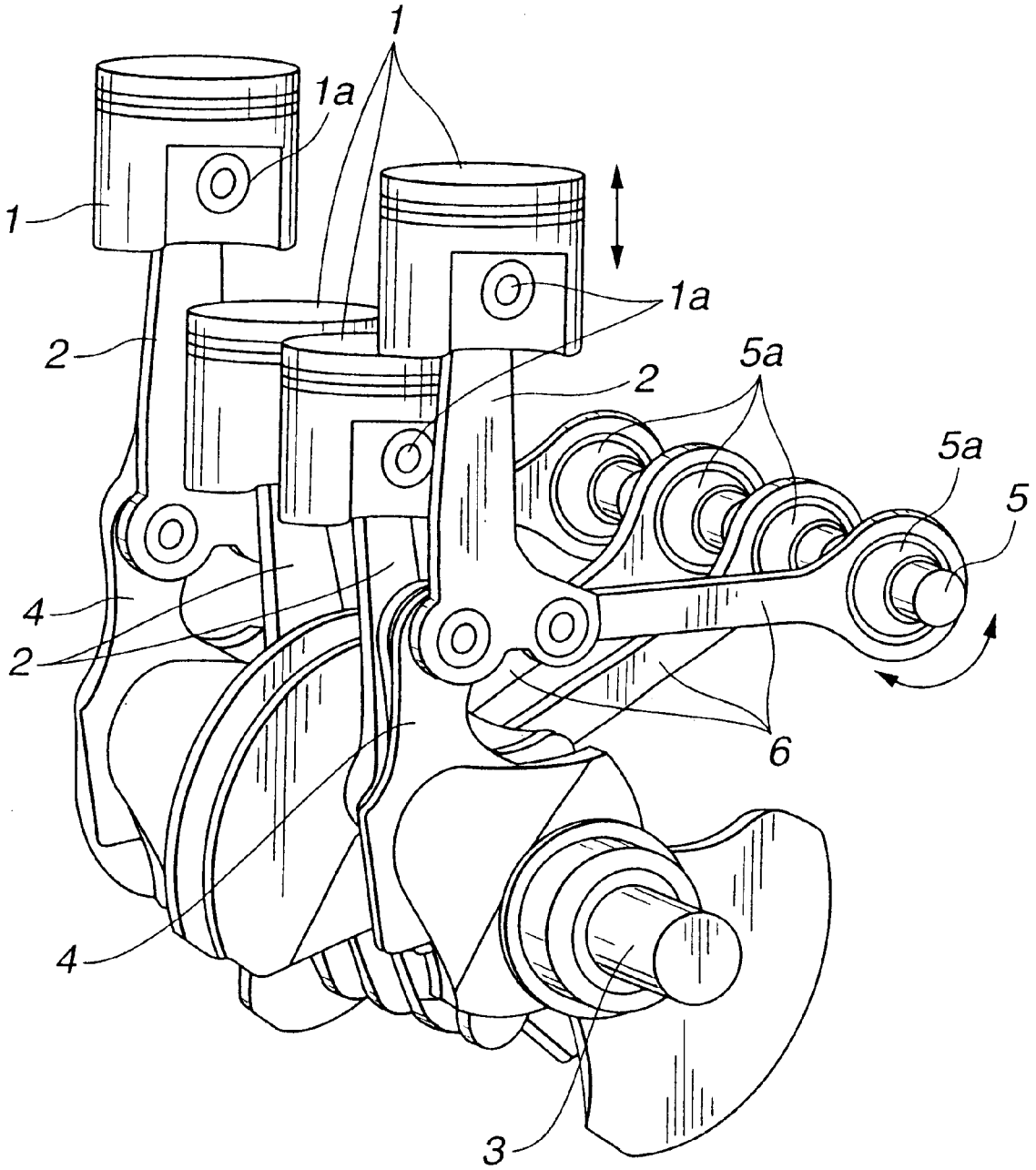
FIG.42 PRIOR ART
FIG. 42 is a perspective view of essential parts of a known internal combustion engine having a variable compression ratio mechanism installed therein.

Thus, existence of the control shaft 90 and its associated parts does not cause a largely expanded structure of one side wall of the cylinder block 10 unlike the above-mentioned known variable compression ratio mechanism of FIG. 42. That is, the variable compression ratio mechanism can be compactly and neatly installed in the engine, and thus the engine according to the present invention can be entirely compact in size.

Since, in the first embodiment, the control links 80 are pivotally connected to the lower links 70, the control shaft 90 and its associated parts can be positioned in a remote space from the upper links 60, that is, in a space which does not induce a lateral expansion of one side wall of the cylinder block 10. While, since, in the above-mentioned known variable compression mechanism of FIG. 42, the control links 6 are connected to the upper links 2, the control shaft 5 and its associated parts are inevitably positioned in a space near the upper links 2, that is, in a space which induces the lateral expansion of one side wall of the cylinder block 10.

In the following, arrangement of the crankshaft 100 and that of the control shaft 90 will be described in detail with reference to the drawings.

As is seen from FIGS. 1 and 2, a bearing portion 20 for rotatably holding each main journal 102 of the crankshaft 100 has a split structure to facilitate the work for assembling the crankshaft 100 to the cylinder block 10. That is, each bearing portion 20 comprises a rounded recess which is formed in a lower surface of the cylinder block 10 and a rounded recess which is formed on a bearing cap 21. As is seen from FIGS. 2 and 4, each bearing cap 21 is in a plate shape, and the bearing caps 21 are equally spaced in the axial direction of the crankshaft 100.

As is also seen from FIGS. 1 and 2, a bearing portion 23 for rotatably holding each main journal 91 of the control shaft 90 has a split structure to facilitate the assembling work for the control shaft 90. Each bearing portion 23 comprises a rounded recess which is formed on a lower surface of a downwardly extending portion 21*a* of the bearing cap 21 and a rounded recess which is formed on an upper surface of a bearing cap 24.

Each bearing cap 21 is secured to the lower surface of the cylinder block 10 by means of connecting bolts 22 and 26 in a manner to rotatably hold the crankshaft 100. Each bearing cap 24 is secured to the corresponding bearing cap 21 by means of connecting bolts 25 and 26 in a manner to rotatably hold the control shaft 90.

That is, each connecting bolt 26 passes through both the bearing cap 21 for the crankshaft 100 and the bearing cap 24 for the control shaft 90 and is secured to the cylinder block 10. In other words, the connecting bolt 26 functions to secure the bearing cap 21 to the cylinder block 10 and secure the bearing cap 24 to the bearing cap 21. This connecting manner can reduce the number of parts used and the steps for assembling the engine.

Figure 3:
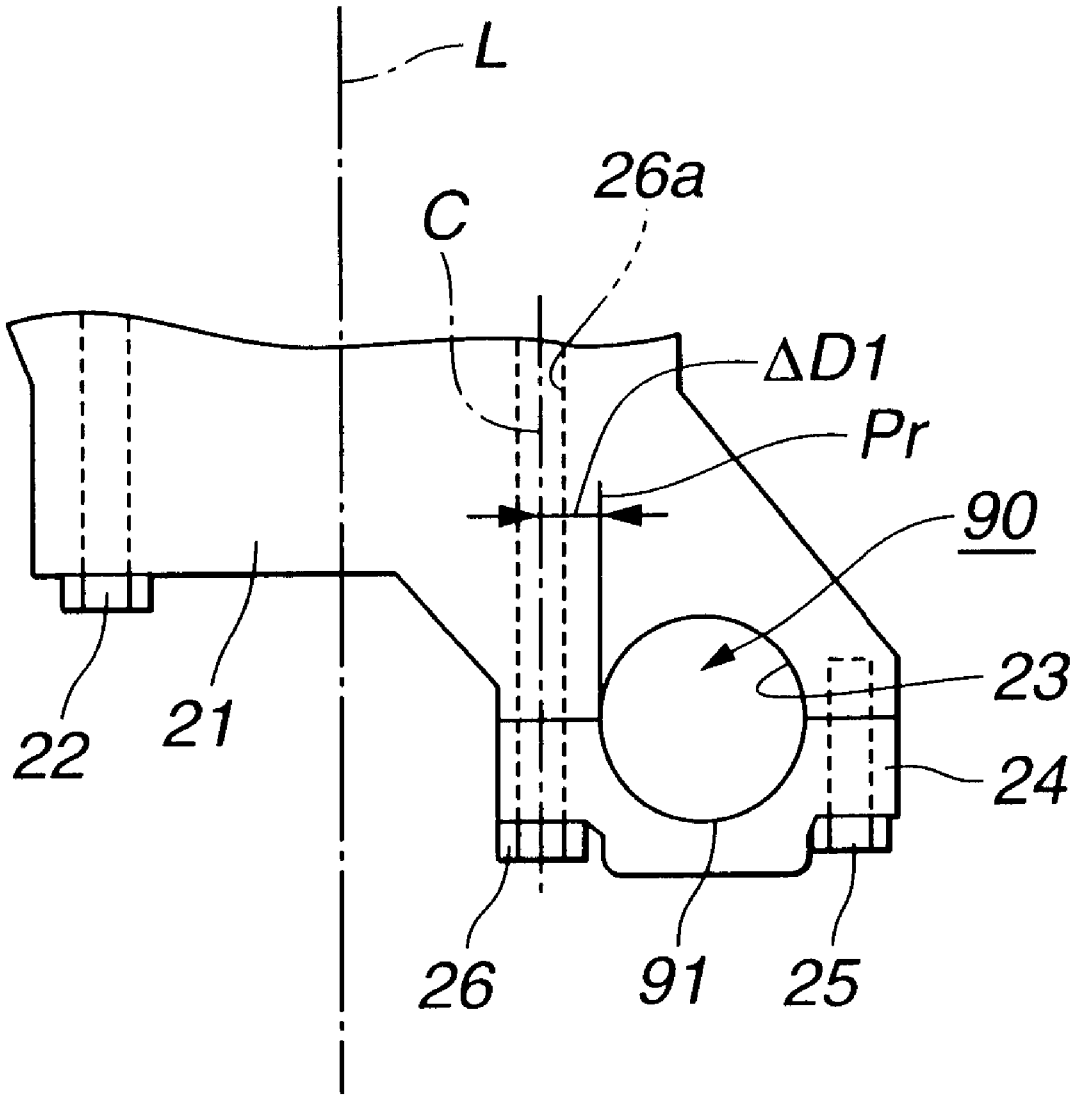
FIG. 3 is a view of an essential portion of the internal combustion engine of the first embodiment.

As is seen from FIGS. 1 and 3, a bolt hole 26*a* for the connecting bolt 26 extends in an axial direction of the cylinder and is positioned between the bearing portion 20 for the crankshaft 100 and the bearing portion 23 for the control shaft 90. More specifically, as is seen from FIGS. 1 and 3, when viewed in an axial direction of the crankshaft 100, a center axis "C" (see FIG. 3) of the connecting bolt 26 is located between the reference line "L" and an imaginary line "Pr" which is the tangential line to a circle of the bearing portion 23 at the position nearest to the reference line "L". The distance "ΔD1" between the center axis "C" and the imaginary line "Pr" is determined sufficiently short.

Accordingly, as is seen from FIG. 1, the distance between the bearing portions 20 and 23 is sufficiently reduced and thus the variable compression ratio mechanism can be reduced in size. Furthermore, since, as is seen from FIG. 3, the center axis "C" of the connecting bolt 26 is positioned near to the reference line "L" as compared with the bearing portion 23, the bearing portion 23 can exhibit satisfied bearing performance and lubrication performance.

In the following, advantages of the engine of the first embodiment will be more clearly described with reference to FIGS. 5 to 7 which show a modification of the first embodiment. In this modification, the distance "ΔD2" between the center axis "C" of the connecting bolt 26 and the imaginary line "Pr" is determined much shorter than the above-mentioned distance "ΔD1". That is, as is shown in FIG. 5, the imaginary line "Pr" is placed in the bolt hole 26*a* for the connecting bolt 26, which brings about much compact construction of the variable compression ratio mechanism.

Figure 5:
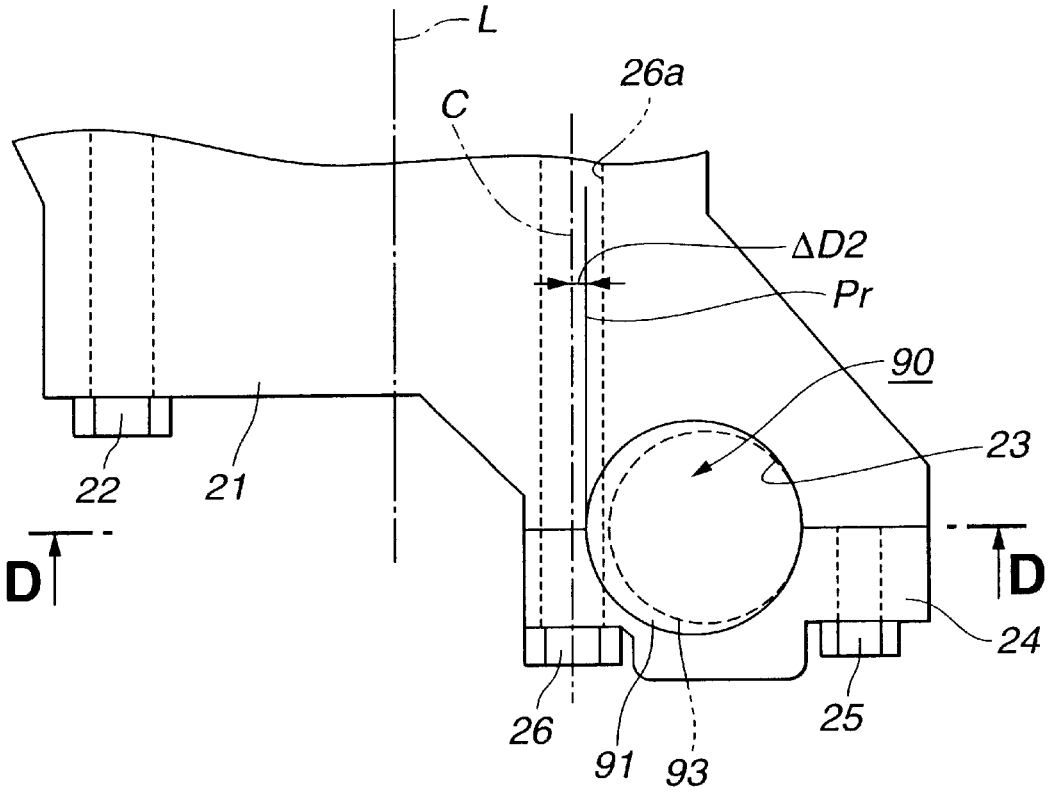
FIG. 5 is a view similar to FIG. 3, but showing a modification of the first embodiment.
Figure 6:
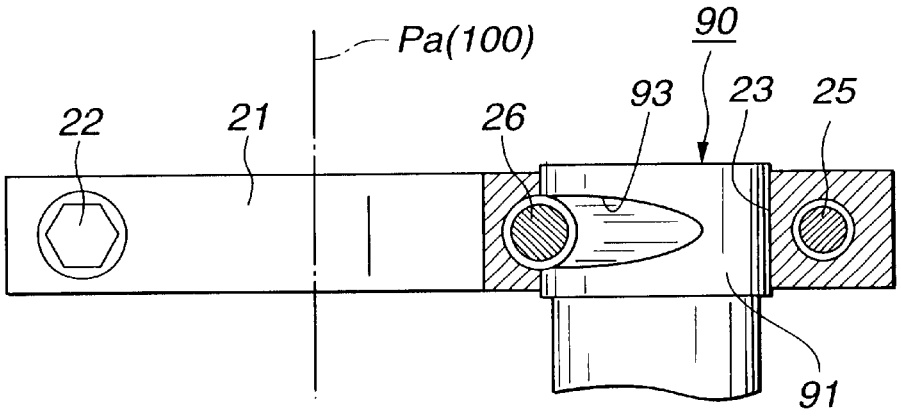
FIG. 6 is a sectional view taken along line "D—D" of FIG. 5.
Figure 7:
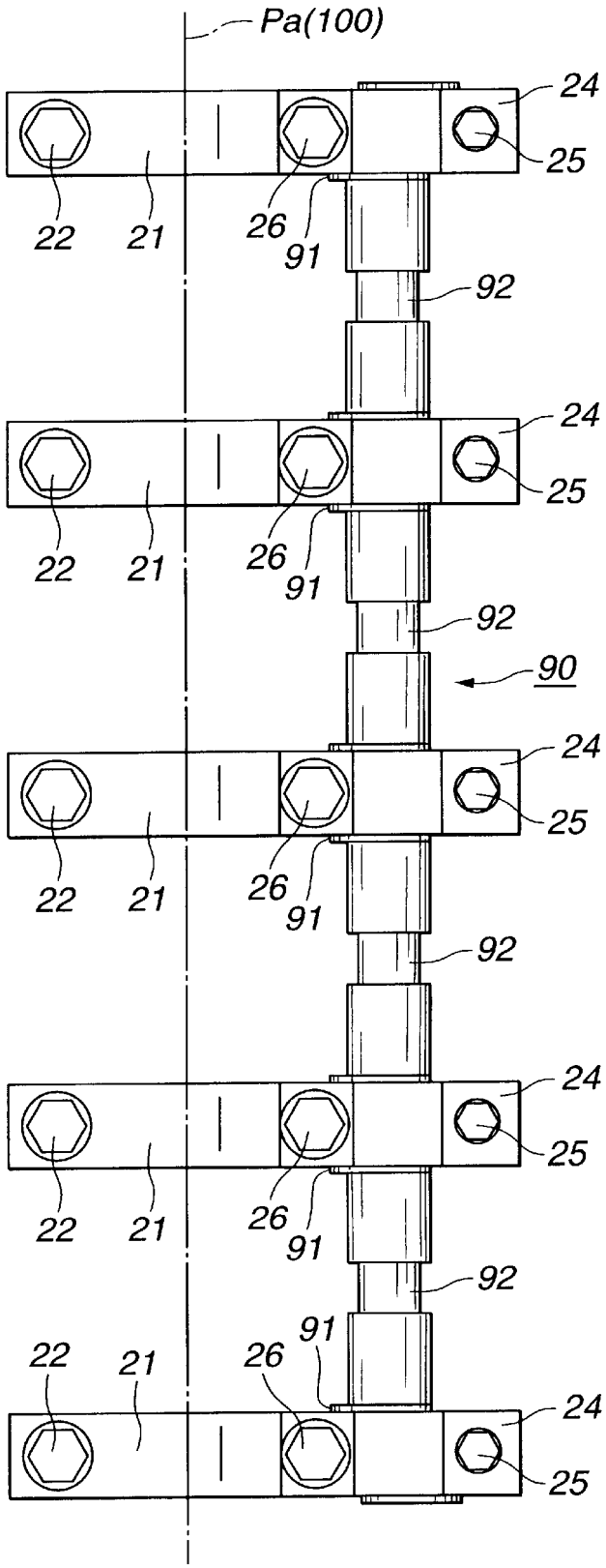
FIG. 7 is a view similar to FIG. 4, but showing the modification of the first embodiment.

As is seen from FIGS. 5 and 6, in the modification, each main journal 91 of the control shaft 90 is formed with a semicircular groove 93 for avoiding interference with the corresponding connecting bolt 26. The semi-circular groove 93 is formed in and around a limited given portion of the major journal 91. Formation of such circular groove 93 should be so made as not to sacrifice the bearing and lubrication performance at the main journal 91. As is seen from FIG. 5, when viewed in an axial direction the control shaft 90, the semi-circular groove 93 has a crescent shape. It has been revealed that even if the distance "ΔD2" is 0 (zero), that is, even when the imaginary line "Pr" is in the position of the center axis "C" of the connecting bolt 26, the main journal 91 exhibits a satisfied bearing and lubrication performance.

In the following, a mechanism for reducing or minimizing undesired vibration of the control shaft 90 will be described with reference to FIGS. 8 to 11.

Figure 8:
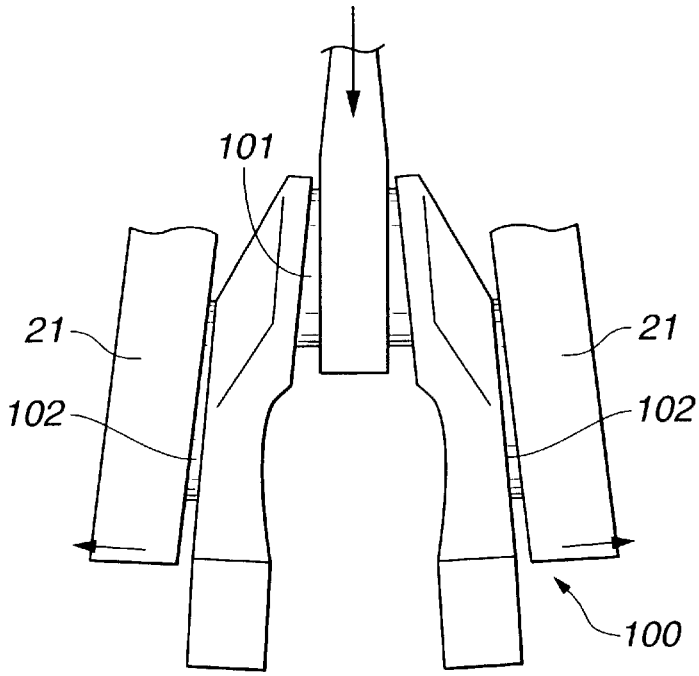
FIGS. 8 and 9 are schematic illustrations of bearing caps for a crankshaft, which are prepared for explaining a distortion of main journals of the crankshaft under operation of the engine.
Figure 9:
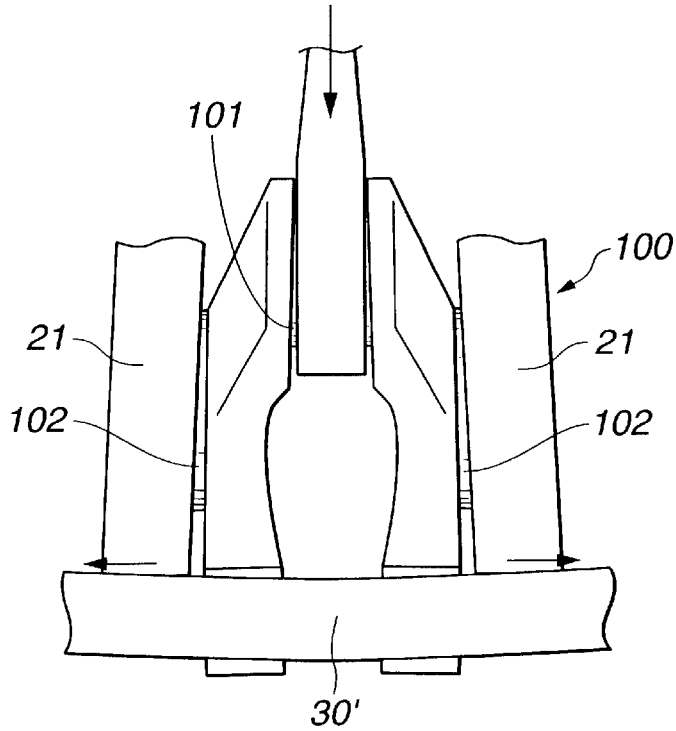

As is seen from an exaggerated view of FIG. 8, under operation of the engine, due to inevitable inclination of the crank pin 101 caused by the compression pressure applied thereto, the main journal 102 of the crankshaft 100 tends to show a distortion. Due to the distortion of the main journal 102, the bearing caps 21 tend to make a vibration and thus produce noises. Hitherto, as is seen from FIG. 9, for reducing or minimizing such undesired vibration and noises of the bearing caps 21, a bearing beam 30' has been used to which the bearing caps 21 are integrally connected.

In the first embodiment of the present invention, the function of such bearing beam 30' is possessed by the control shaft 90, as will be apparent from the following description.

Figure 10:
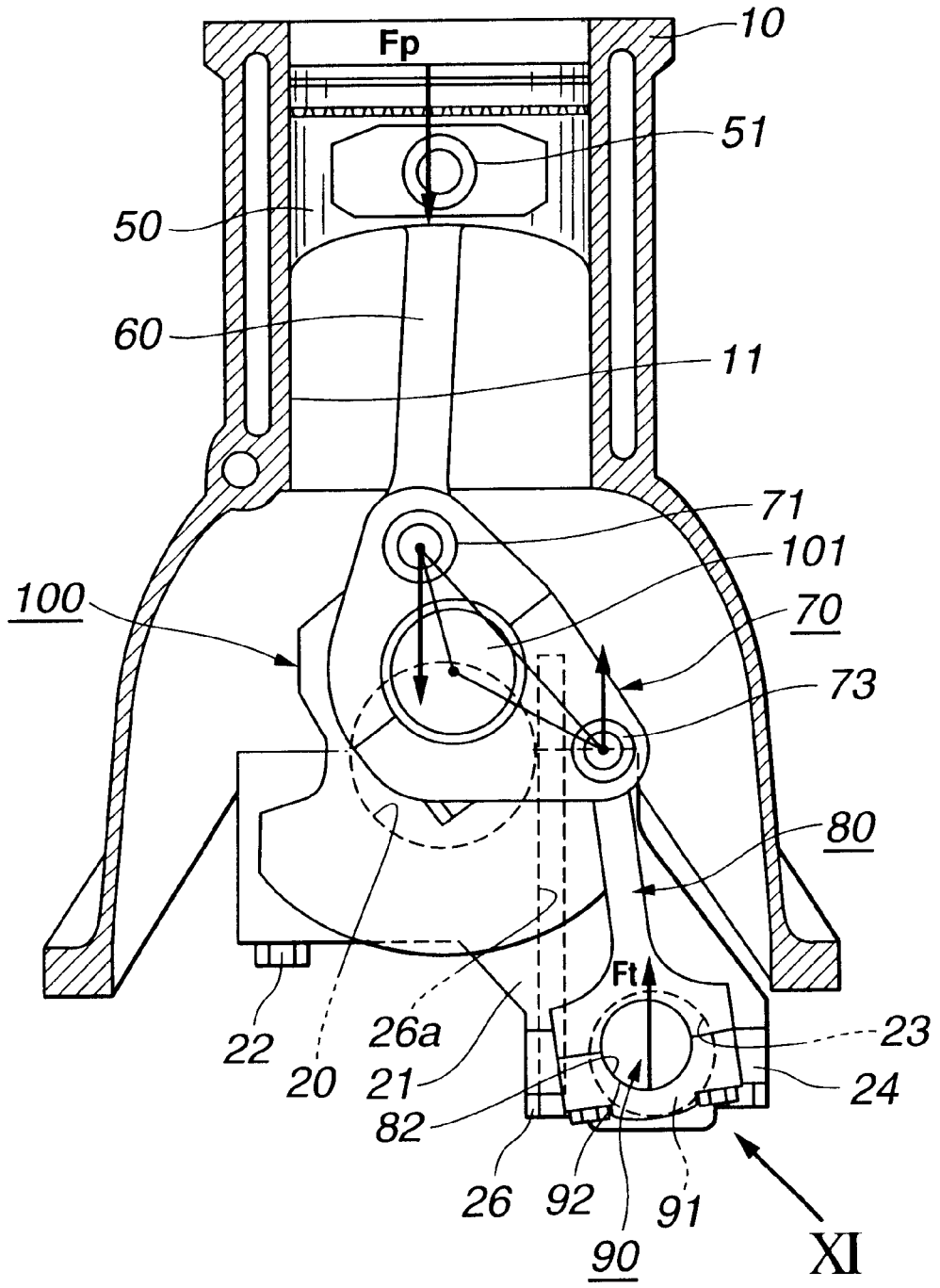
FIG. 10 is an illustration of the engine for explaining operation of the internal combustion engine of the first embodiment.
Figure 11:
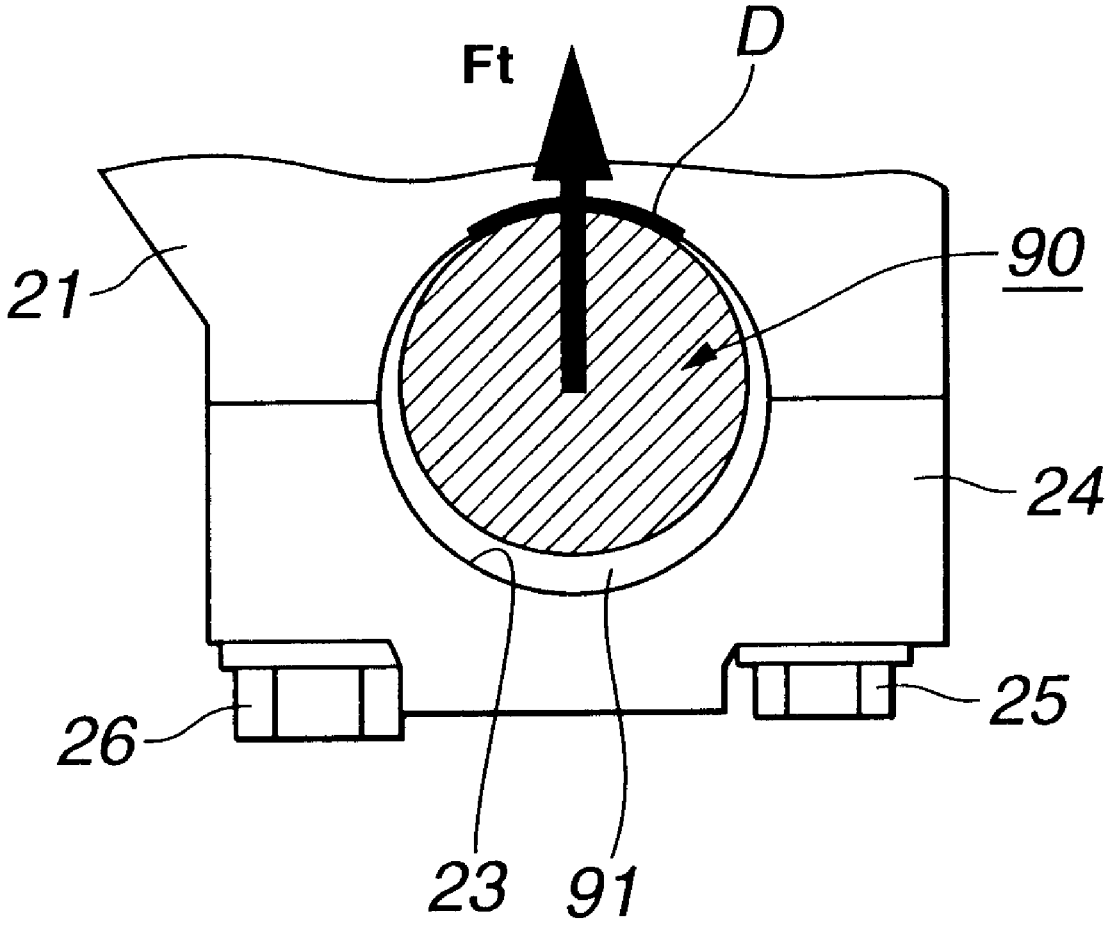
FIG. 11 is an enlarged view of the portion indicated by an arrow "X1" of FIG. 10, showing a load applied to a control shaft.

That is, as is seen from FIGS. 10 and 11, under operation of the engine, due to a combustion pressure "Fp" applied to the piston 50, there is applied a load "Ft" from the bearing portion 23 to the control shaft 90, which causes increase in friction factor "$\mu$" between the bearing portion 23 and the control shaft 90. Against such load "Ft" applied to the control shaft 90, there is produced a counter force of the magnitude "$\mu \times$Ft" at a contacting position "D" between the bearing portion 20 and the control shaft 90. It is to be noted that the counter force "$\mu \times$Ft" thus produced functions to cancel the load by which the bearing caps 21 would be deformed. In other words, the control shaft 90 can serve as a so-called reinforcing beam which integrally connects the bearing caps 21. Thus, in the first embodiment, the undesired vibration of the bearing caps 21 for the crankshaft 100 is effectively suppressed or minimized.

Figure 12:
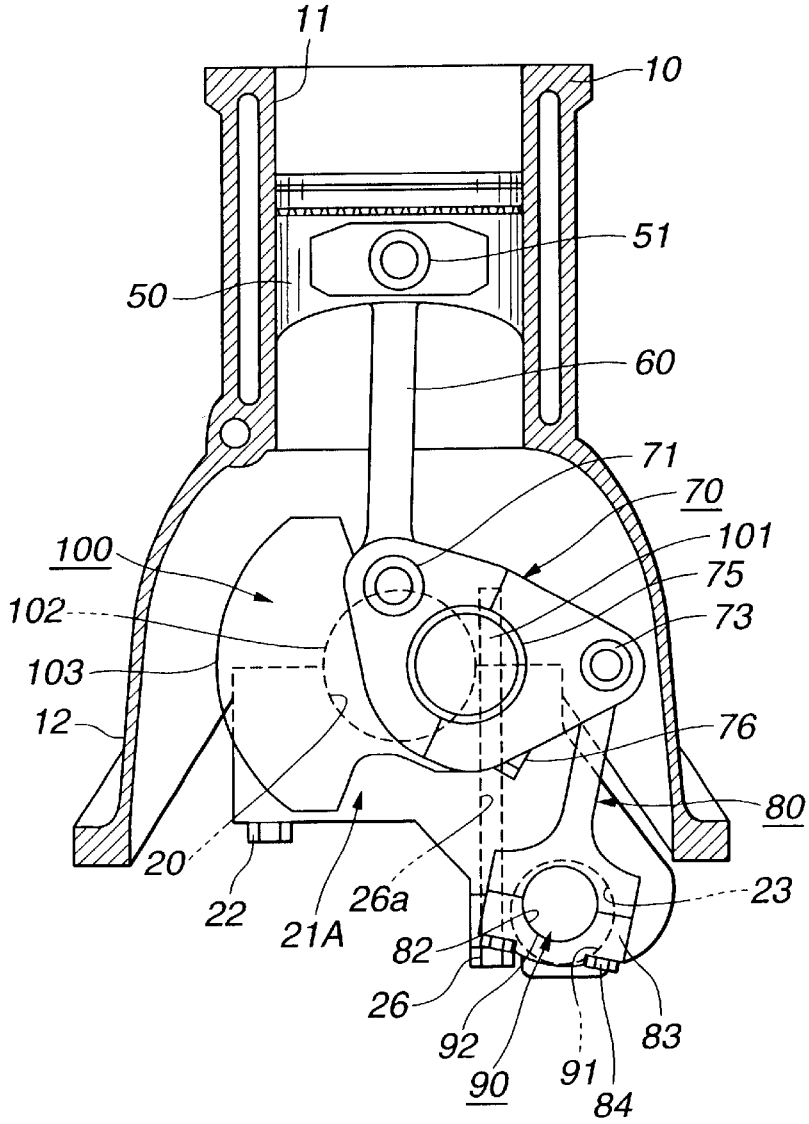
FIG. 12 is a view similar to FIG. 1, but showing a second embodiment of the present invention.
Figure 13:
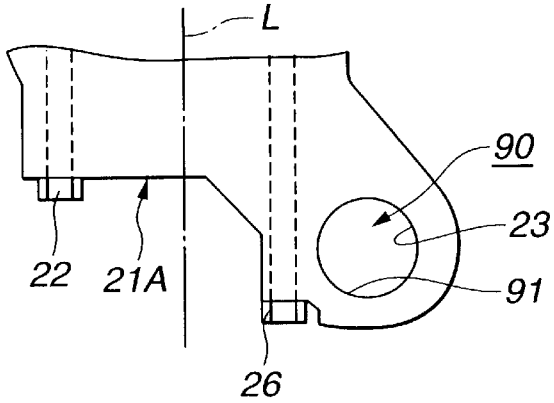
FIG. 13 is a view of an essential portion of the engine of the second embodiment.
Figure 14:
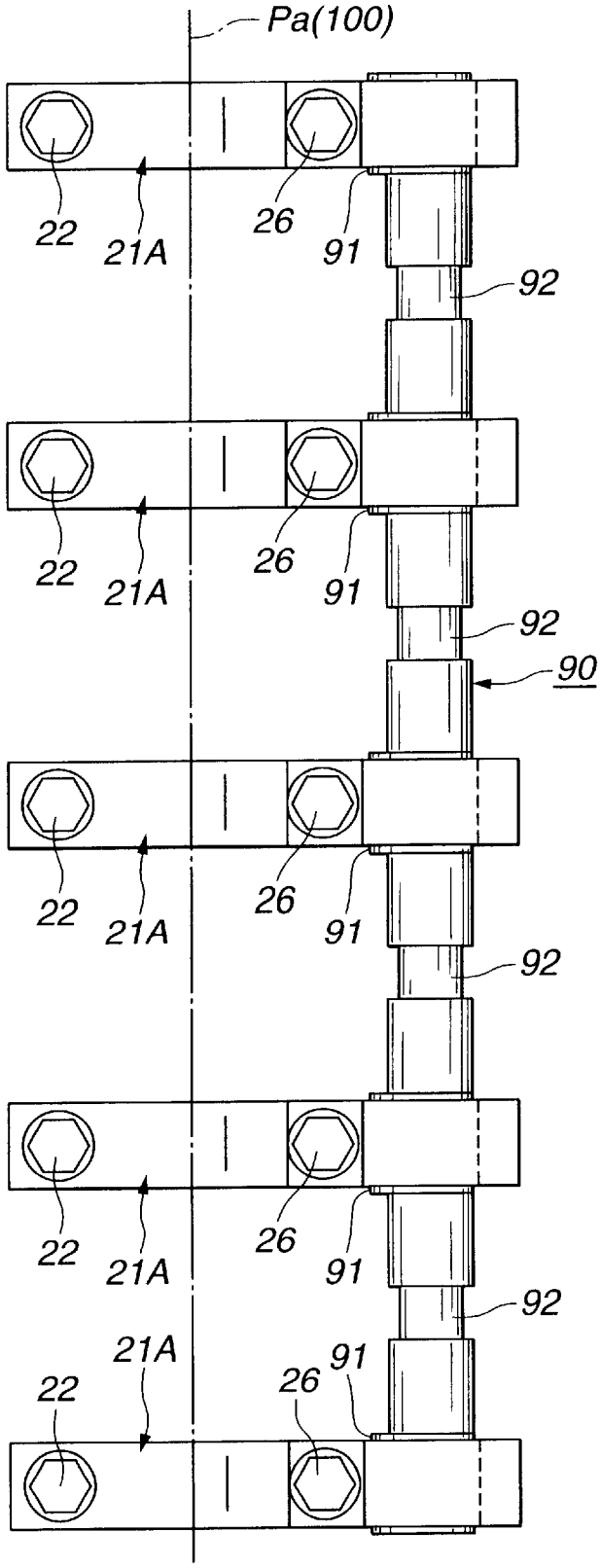
FIG. 14 is a bottom view of the variable compression ratio mechanism associated with the second embodiment.

Referring to FIGS. 12 to 14, there is shown an internal combustion engine of a second embodiment of the present invention.

In this second embodiment, to each of the bearing caps 21A for the crankshaft 100, there is integrally connected the bearing portion 23 for the control shaft 90. That is, as is seen from FIG. 13, the bearing cap 21A is integral with the bearing portion 23. Unlike in the above-mentioned first embodiment, the bearing portion 23 has not a split structure, and thus in the second embodiment, there are no members corresponding to the bearing caps 24 and the connecting bolts 25 which are used in the first embodiment. Although the facility of assembling the control shaft 90 to the bearing portion 23 is somewhat poor as compared with the first embodiment, reduction in number of parts and simplification of the construction are achieved in the second embodiment.

Figure 15:
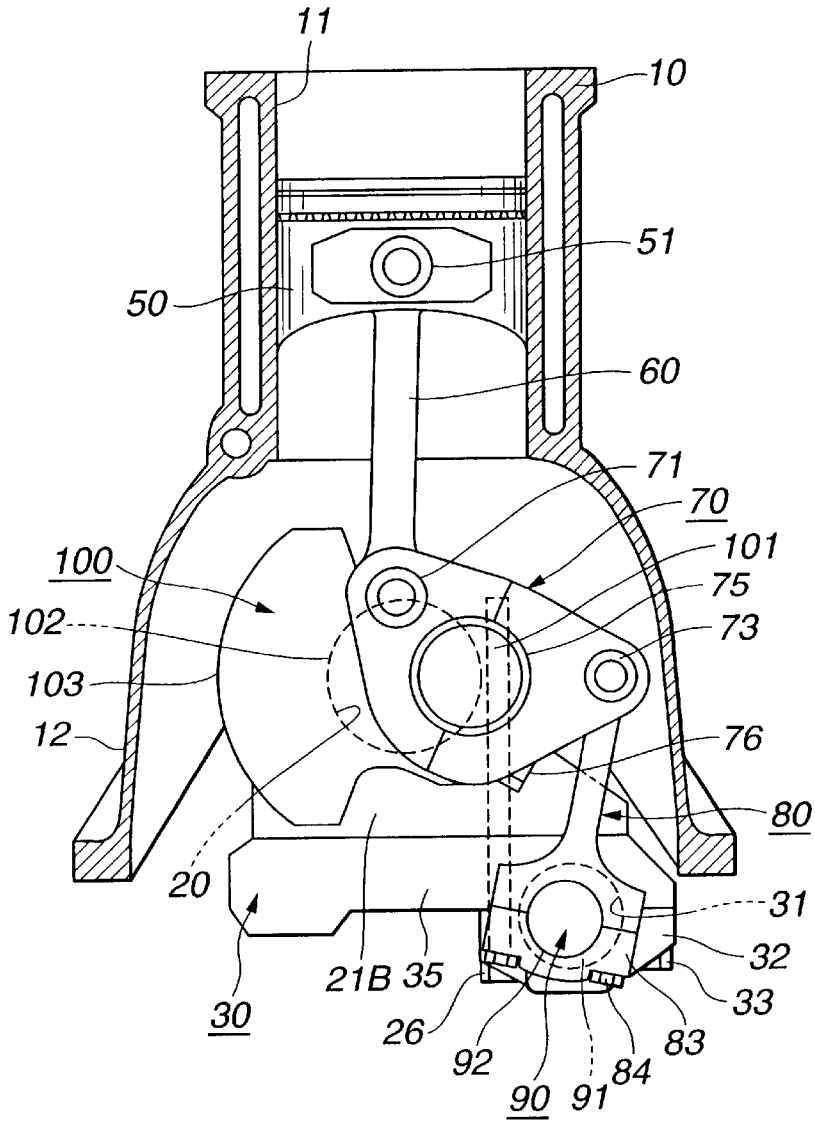
FIG. 15 is a view similar to FIG. 1, but showing a third embodiment of the present invention.
Figure 16:
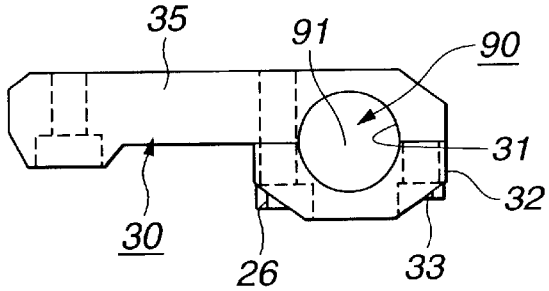
FIG. 16 is an enlarged view of an essential portion of the engine of the third embodiment.
Figure 17:
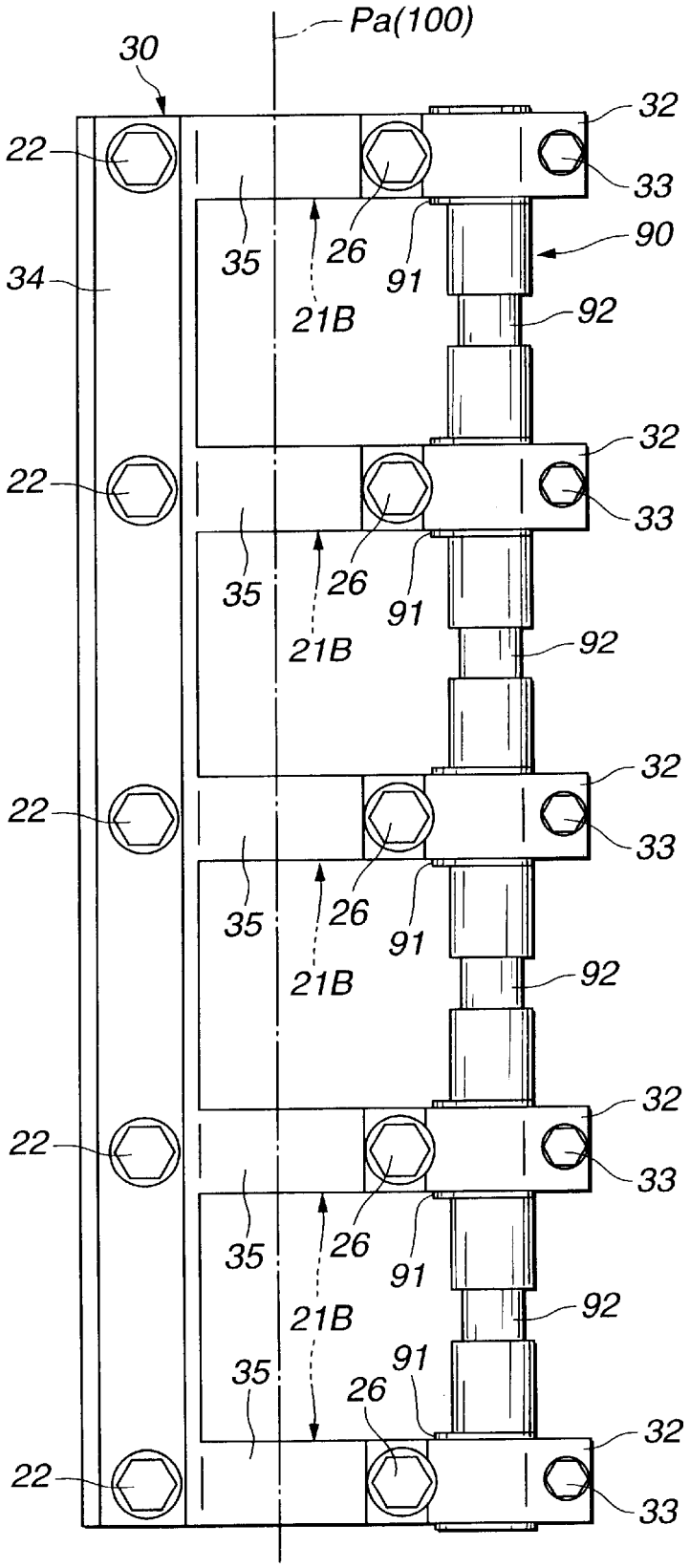
FIG. 17 is a bottom view of the variable compression ratio mechanism associated with the third embodiment.

Referring to FIGS. 15 to 17, there is shown an internal combustion engine of a third embodiment of the present invention.

In this third embodiment, to lower surfaces of the bearing caps 21B, there is secured a bearing beam 30. As is seen from FIG. 17, the bearing beam 30 comprises a plurality of branch plate portions 35 which are secured to the lower surfaces of the bearing caps 21B and an elongate base plate portion 34 which connects the branch plate portions 35 integrally.

As is seen from FIG. 16, the bearing beam 30 is formed with bearing portions 31 for the control shaft 90. Each bearing portion 31 has a split structure for facilitating the work for assembling the control shaft 90 thereto. That is, each bearing portion 31 comprises a rounded recess formed in a lower surface of the branch plate portion 35 of the bearing beam 30 and a rounded recess formed in an upper surface of a bearing cap 32 which is bolted to the lower surface of the branch plate portion 35.

As is understood from FIG. 17, the bearing beam 30 and the bearing caps 21B are secured to a lower surface of the cylinder block 10 by means of connecting bolts 22 and 26. While, the bearing caps 32 for the control shaft 90 are secured to the lower surface of the branch plate portions 35 of the bearing beam 30 by means of connecting bolts 26 and 33. It is to be noted that the connecting bolts 26 are used for connecting the bearing beam 30 and the bearing caps 21B to the cylinder block 10 and connecting the bearing caps 32 for the control shaft 90 to the branch plate portions 35 of the bearing beam 30. Due to this arrangement, reduction in number of parts and simplification of the construction are achieved. For assembling the variable compression ratio mechanism, the bearing beam 30, the control shaft 90 and the bearing caps 32 are temporarily assembled to provide a loose unit and then this unit is tightly secured to the bearing caps 21B for the crankshaft 21B.

Like in the above-mentioned first and second embodiments, the control shaft 90 functions to serve as a reinforcing beam for the bearing caps 21B. Furthermore, as is seen from FIG. 17, since, in this third embodiment, the elongate base plate portion 34 of the bearing beam 30 is positioned at a side opposite to the control shaft 90 with respect to the bearing portion 20 for the crankshaft 100, undesired vibration of the bearing caps 21B for the crankshaft 100 is much effectively suppressed. Because the control shaft 90 can serve as the reinforcing beam, the mechanical strength needed by the elongate base plate portion 34 of the bearing beam 30 can be small, which brings about a light weight construction of the variable compression ratio mechanism.

Figure 18:
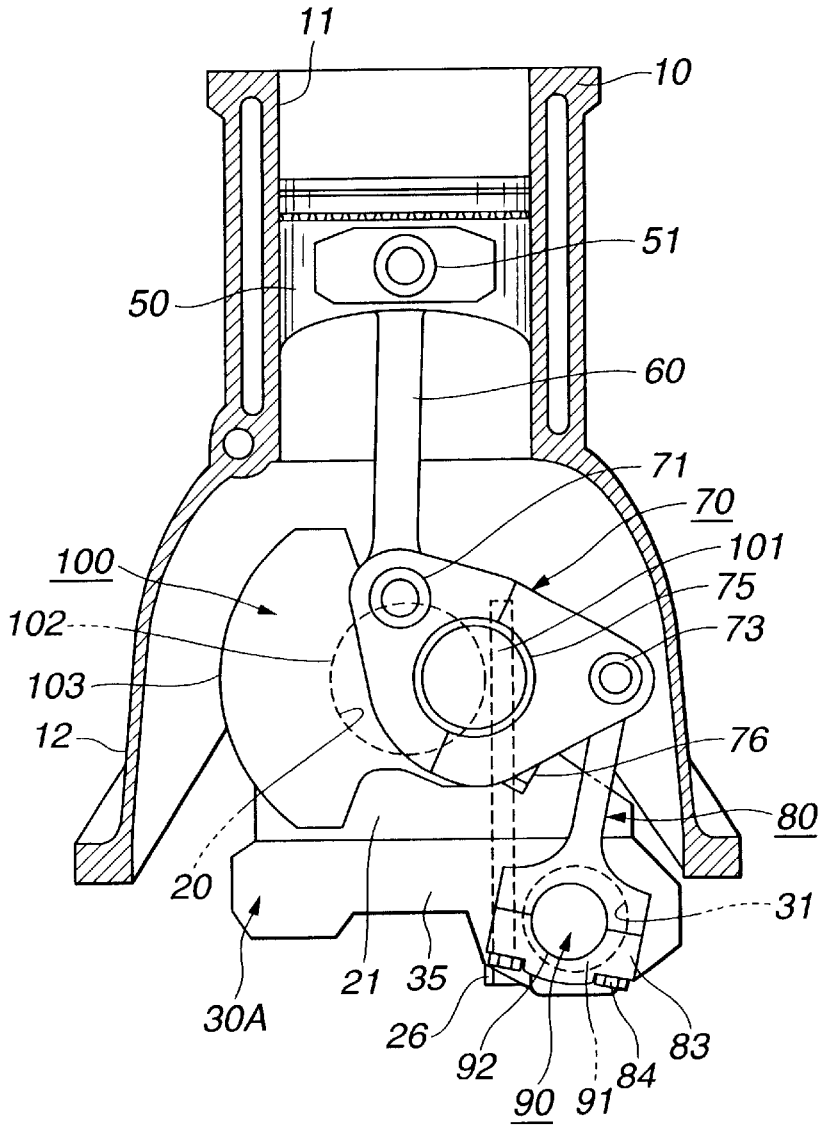
FIG. 18 is a view similar to FIG. 1, but showing a fourth embodiment of the present invention.
Figure 19:
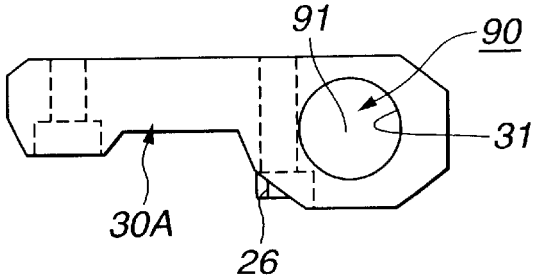
FIG. 19 is a view of an essential portion of the engine of the fourth embodiment.
Figure 20:
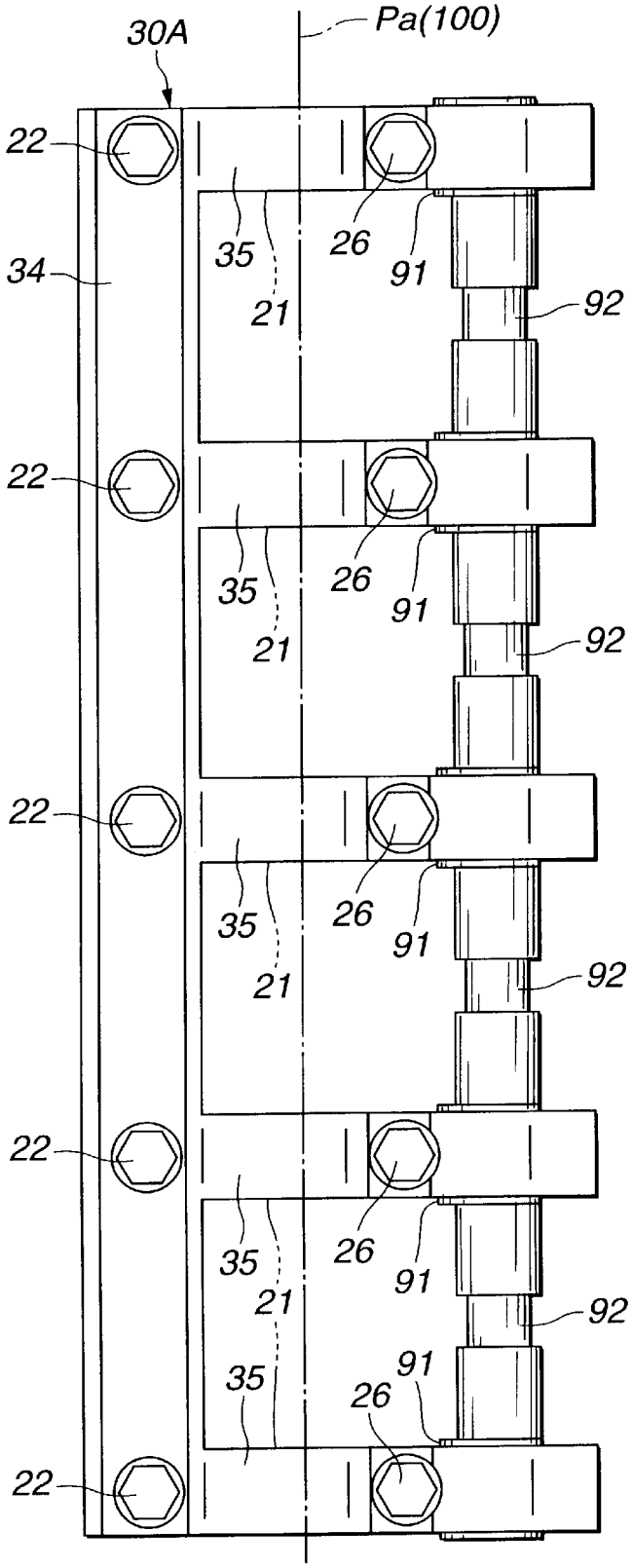
FIG. 20 is a bottom view of the variable compression ratio mechanism associated with the fourth embodiment.

Referring to FIGS. 18 to 20, there is shown an internal combustion engine of a fourth embodiment of the present invention.

The fourth embodiment is substantially the same as the above-mentioned third embodiment except that in the fourth embodiment, each bearing portion 31 has not a split structure. That is, as is seen from FIG. 19, entire construction of each bearing portions 31 is defined or formed by the bearing beam 30A, and thus there are no members corresponding to the 10 bearing caps 32 and the connecting bolts 33 which are used in the third embodiment. Thus, as compared with the third embodiment, reduction in number of parts and simplification of the construction are achieved in the fourth embodiment.

Figure 21:
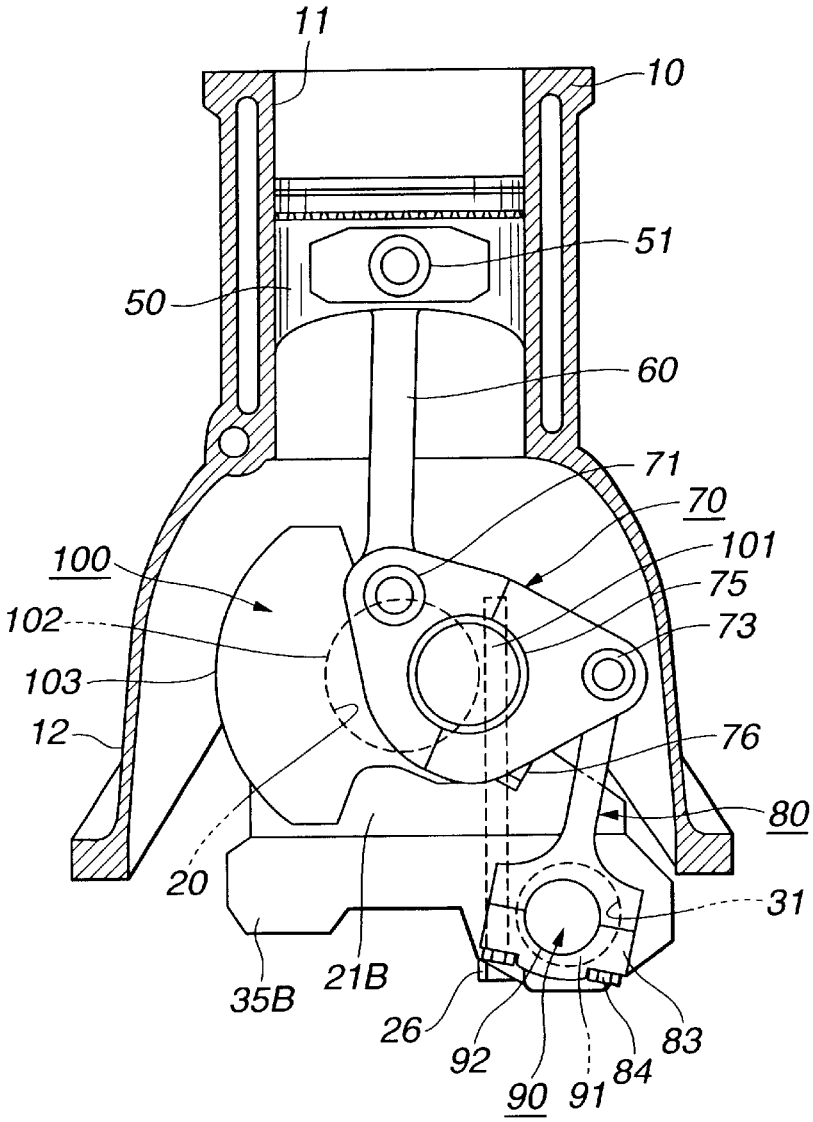
FIG. 21 is a view similar to FIG. 1, but showing a fifth embodiment of the present invention.
Figure 22:
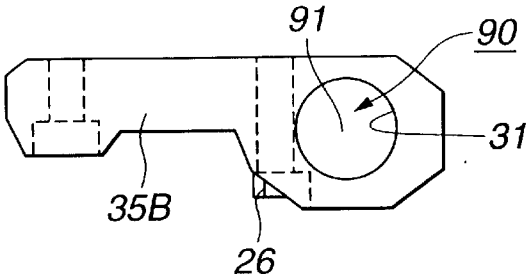
FIG. 22 is a view of an essential portion of the engine of the fifth embodiment.
Figure 23:
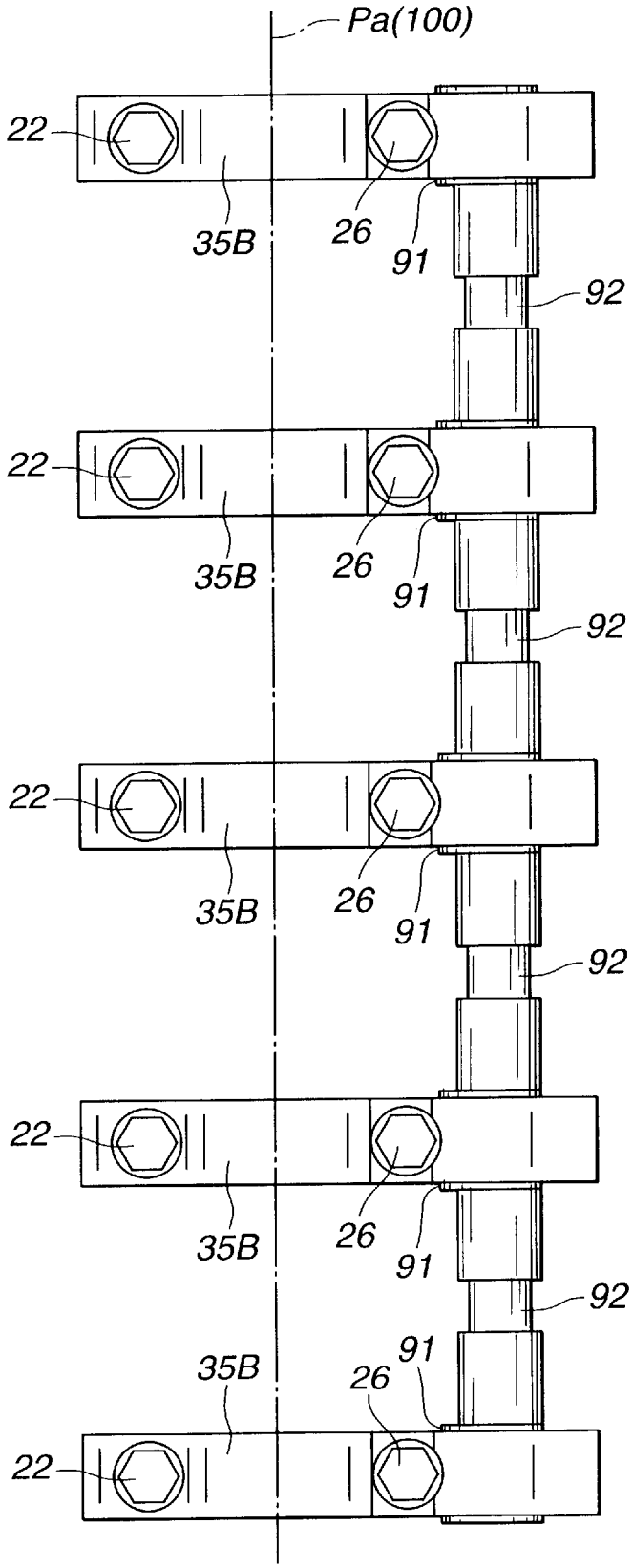
FIG. 23 is a bottom view of the variable compression ratio mechanism associated with the engine of the fifth embodiment.

Referring to FIGS. 21 to 23, there is shown an internal combustion engine of a fifth embodiment of the present invention.

In this fifth embodiment, to lower surfaces of the bearing caps 21B for the crankshaft 100, there are secured respective supporting blocks 35B. Each supporting block 35B has substantially the same construction as the branch plate portion 35 of the bearing beam 30 employed in the fourth embodiment. As is seen from FIG. 23, in this fifth embodiment, there is no member corresponding to the elongate base plate portion 34 of the bearing beam 30 employed in the fourth embodiment. Although the vibration suppressing function is somewhat poor due to omission of the elongate base plate portion 34, lighter construction of the variable compression ratio mechanism is achieved in this fifth embodiment.

Figure 24:
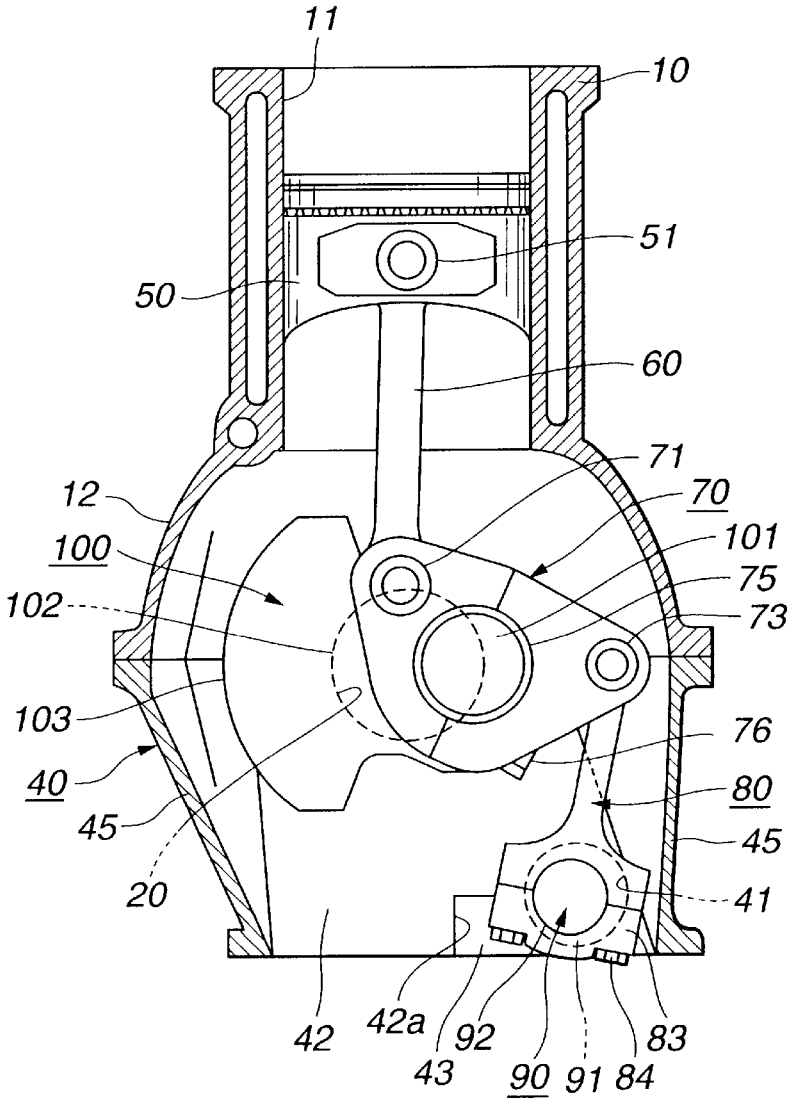
FIG. 24 is a view similar to FIG. 1, but showing a sixth embodiment of the present invention.
Figure 25:
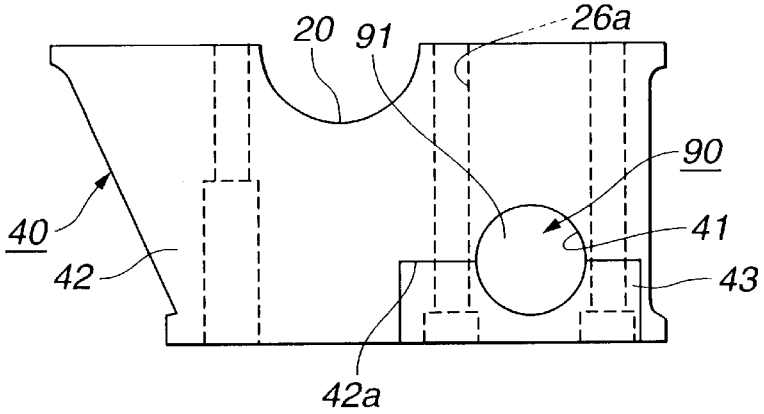
FIG. 25 is an enlarged view of an essential portion of the engine of the sixth embodiment.
Figure 26:
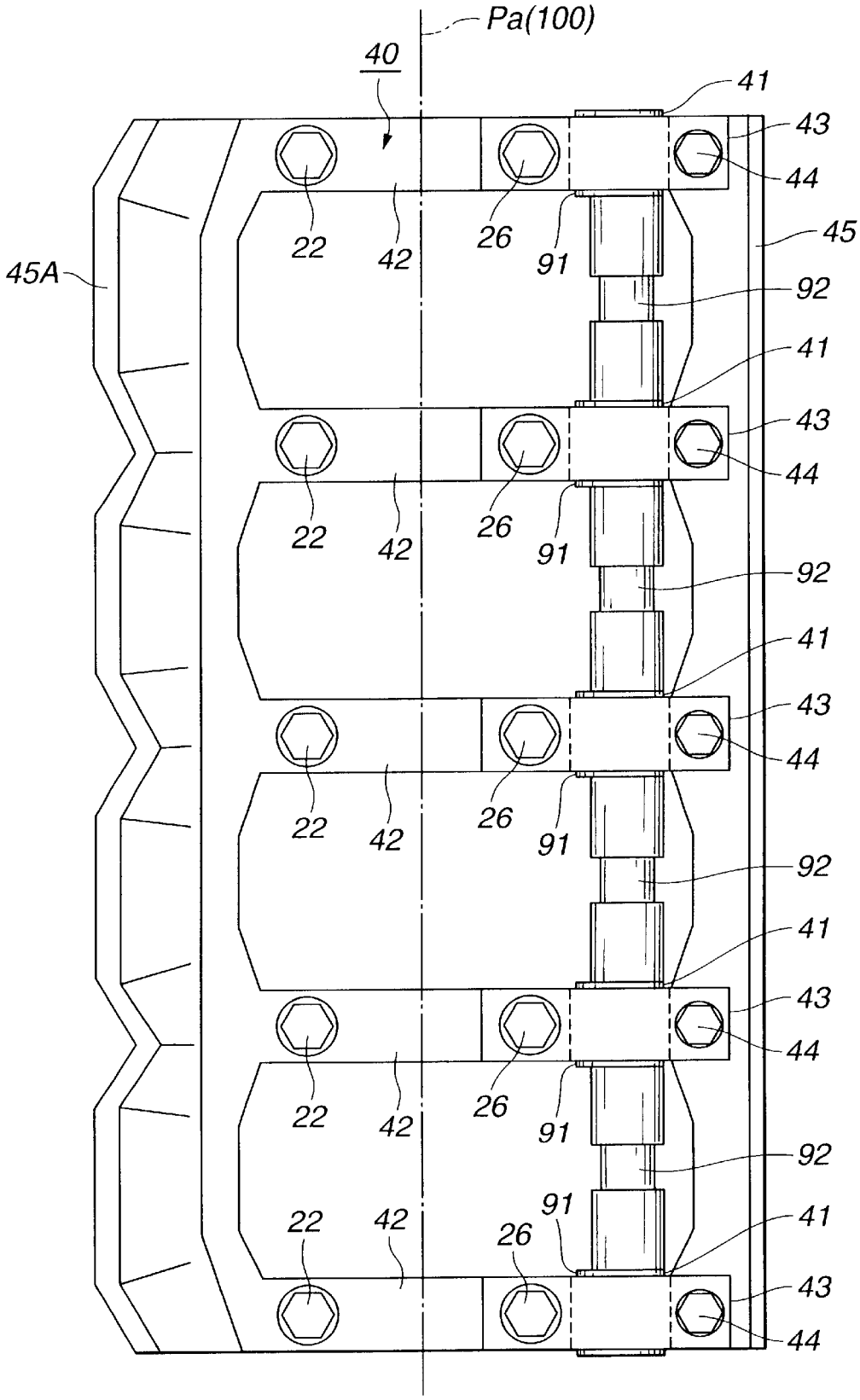
FIG. 26 is a bottom view of the variable compression ratio mechanism associated with the engine of the sixth embodiment.

Referring to FIGS. 24 to 26, there is shown an internal combustion engine of a sixth embodiment of the present invention.

In this sixth embodiment, between a lower end of the skirt section 12 of the cylinder block 10 and an upper end of an oil pan (not shown), there is disposed a ladder frame 40 which constitutes a part of the crankcase together with the skirt section 12. As is seen from FIG. 26, the ladder frame 40 comprises a plurality of bearing caps 42 which are spacedly juxtaposed in the axial direction of the crankshaft 100 to rotatably support the main journals 102 of the crankshaft 100, and two opposed wall portions 45A and 45B between which the bearing caps 42 extend. The opposed wall portions 45A and 45B constitute part of side walls of the engine.

The bearing portion 20 for rotatably supporting each main journal 102 of the crankshaft 100 has a split structure. That is, each bearing portion 20 comprises a rounded recess formed in a lower surface of the cylinder block 10 and a rounded recess formed in an upper surface of each bearing cap 42.

Furthermore, a bearing portion 41 for rotatably supporting each main journal 91 of the control shaft 90 has a split structure. That is, the bearing portion 41 comprises a rounded recess formed in a lower surface of the bearing cap 42 and a rounded recess formed in a upper surface of a bearing cap 43 for the control shaft 90. As is seen from FIG. 25, the bearing cap 42 for the crankshaft 100 is formed with a recess 42*a* with which the bearing cap 43 for the control shaft 90 is mated.

As is described hereinabove, in the sixth embodiment, the bearing cap 42 for the crankshaft 100 is formed with both the bearing portion 20 for the crankshaft 100 and the bearing portion 41 for the control shaft 90. That is, similar to the bearing cap 21 employed in the first embodiment, the bearing cap 42 has two bearing portions.

As is seen from FIG. 26, each bearing cap 42 for the crankshaft 100 is secured to the lower surface of the cylinder block 10 by means of the connecting bolts 22 and 26. Furthermore, each bearing cap 43 for the control shaft 90 is secured to the bearing cap 42 by means of the connecting bolt 26 and a connecting bolt 44. That is, the connecting bolt 26 functions to secure both the bearing cap 42 and the bearing cap 43 to the cylinder block 10.

Since, in the sixth embodiment, the opposed wall portions 45A and 45B of the ladder frame 40 function as a reinforcing means for the bearing caps 42 for the crankshaft 100 like the control shaft 90, undesired vibration of the bearing caps 42 is much assuredly suppressed.

Figure 27:
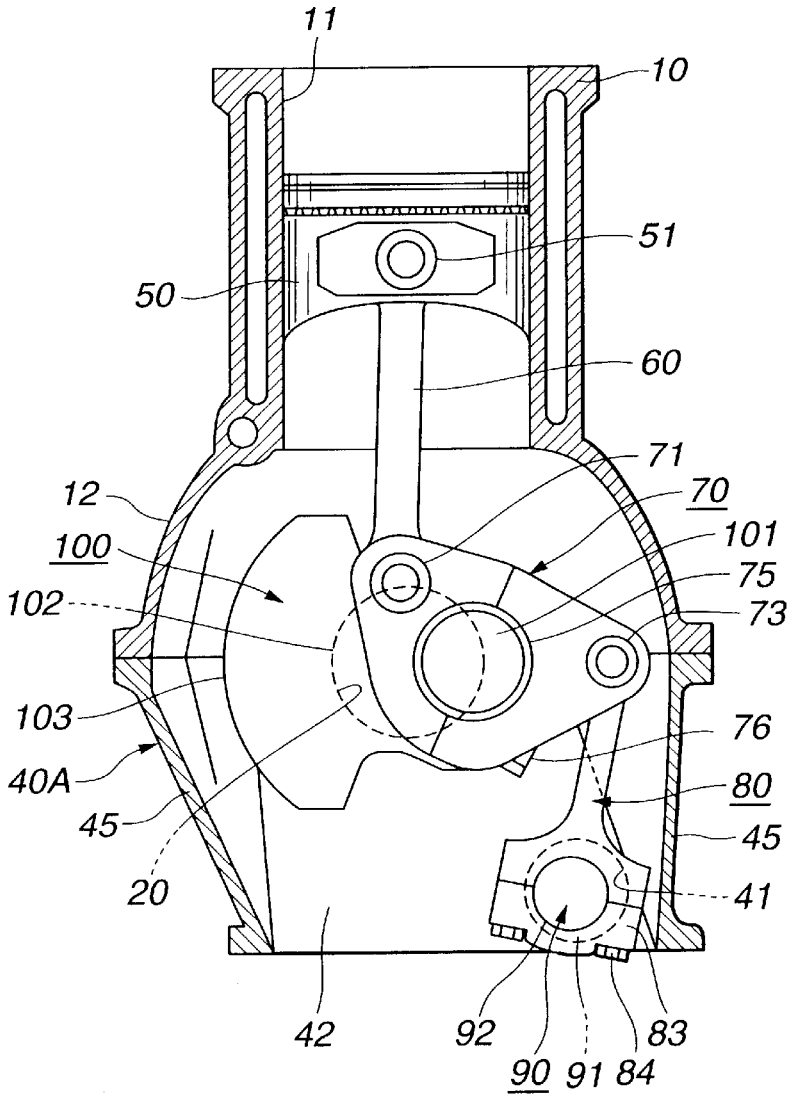
FIG. 27 is a view similar to FIG. 1, but showing a seventh embodiment of the present invention.
Figure 28:
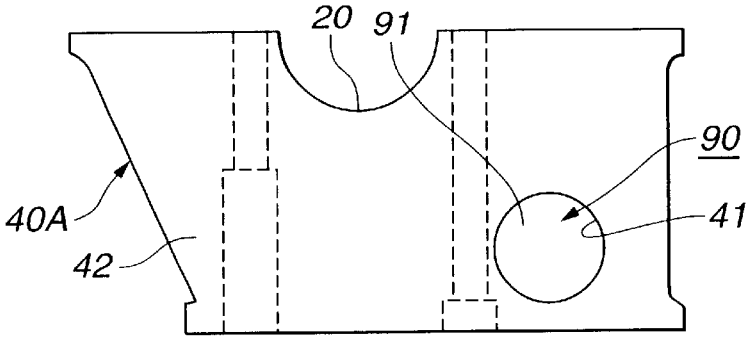
FIG. 28 is an enlarged view of an essential portion of the engine of the seventh embodiment.
Figure 29:
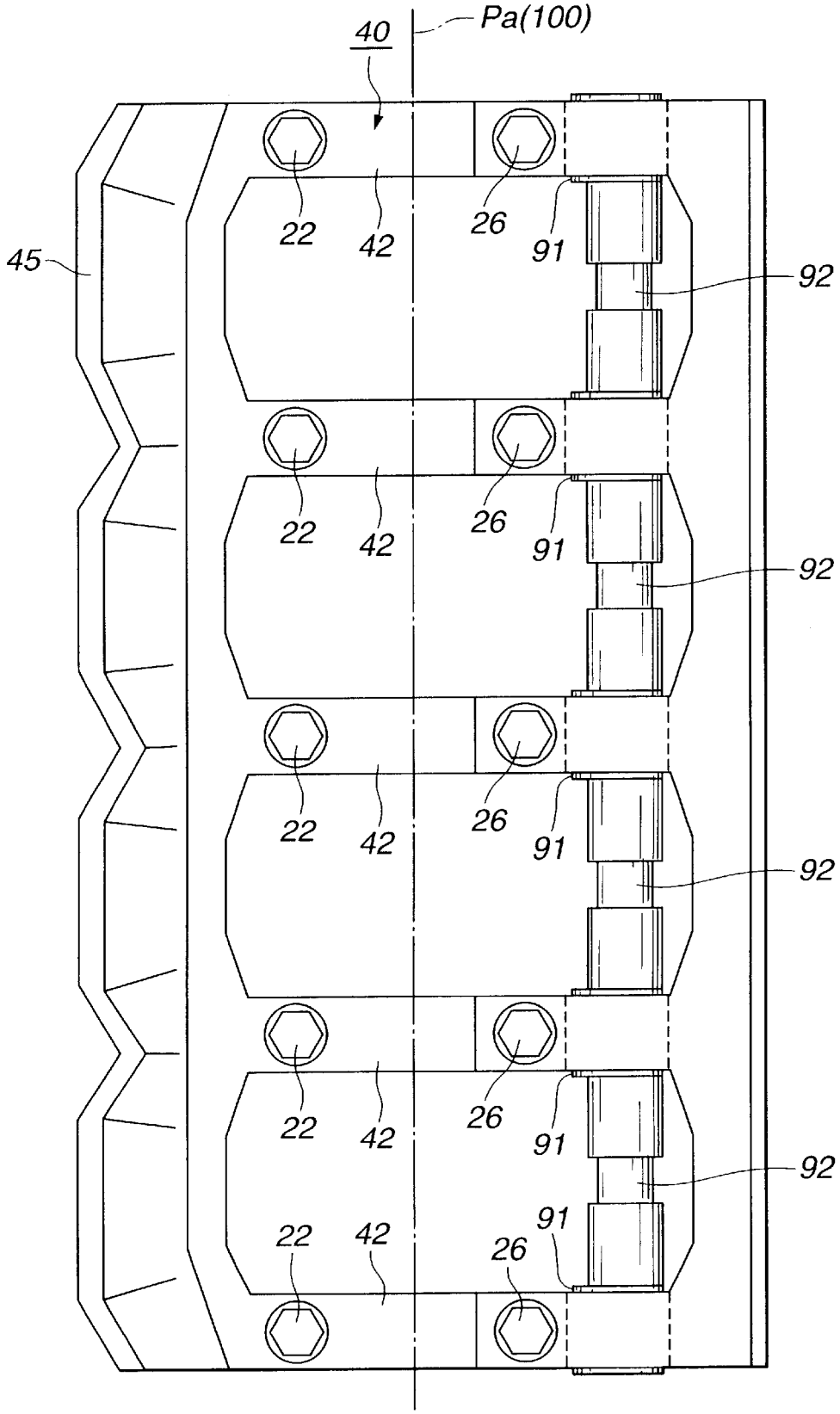
FIG. 29 is a bottom view of the variable compression ratio mechanism associated with the engine of the seventh embodiment.

Referring to FIGS. 27 to 29, there is shown an internal combustion engine of a seventh embodiment of the present invention.

The seventh embodiment is substantially the same as the above-mentioned sixth embodiment except that in the seventh embodiment, each bearing portion 41 has not a split structure. That is, as is seen from FIG. 28, entire construction of each bearing portion 41 is defined or formed by the bearing cap 42 of the ladder frame 40A.

Figure 30:
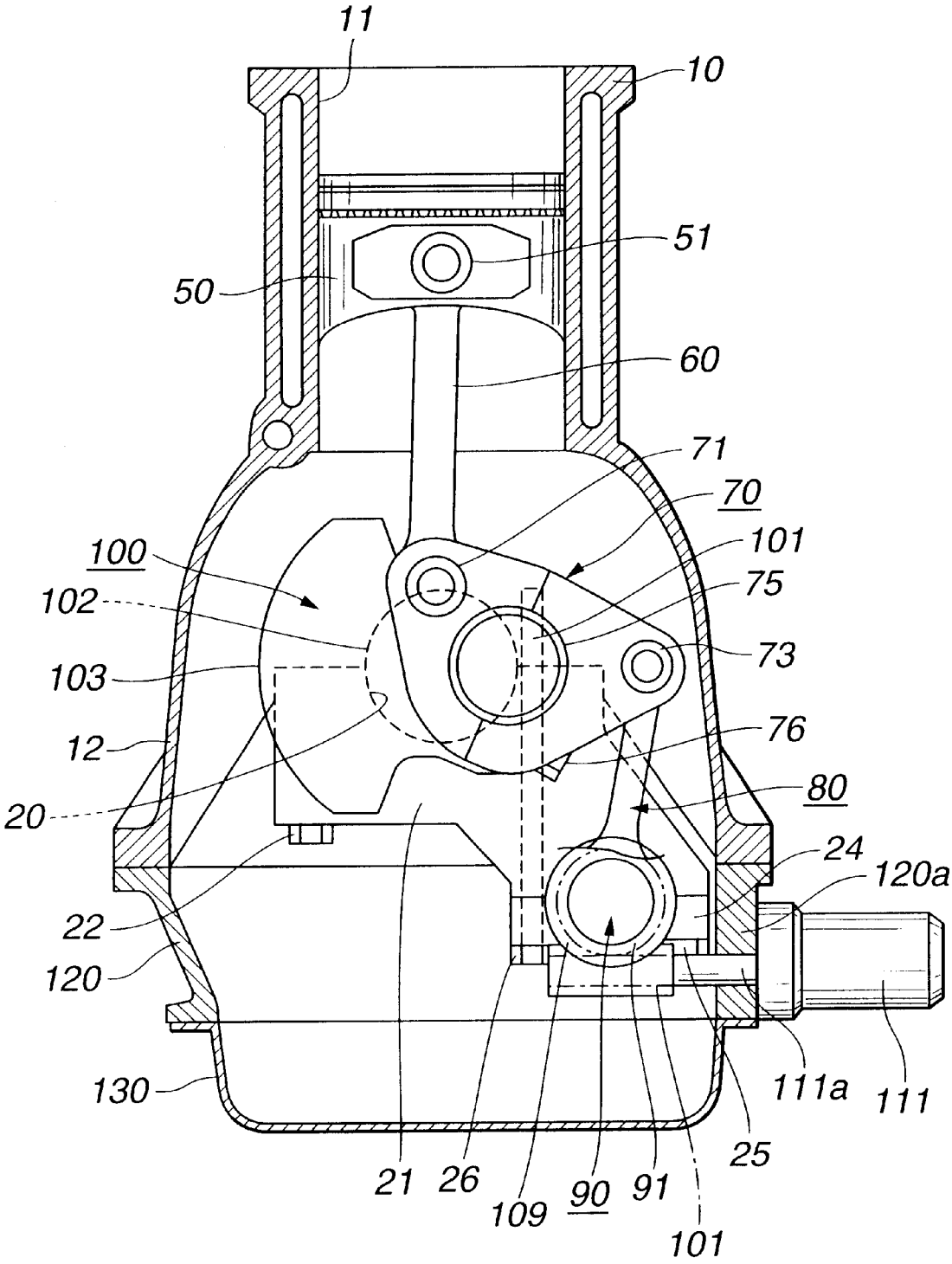
FIG. 30 is a view similar to FIG. 1, but showing an eighth embodiment of the present invention.
Figure 31:
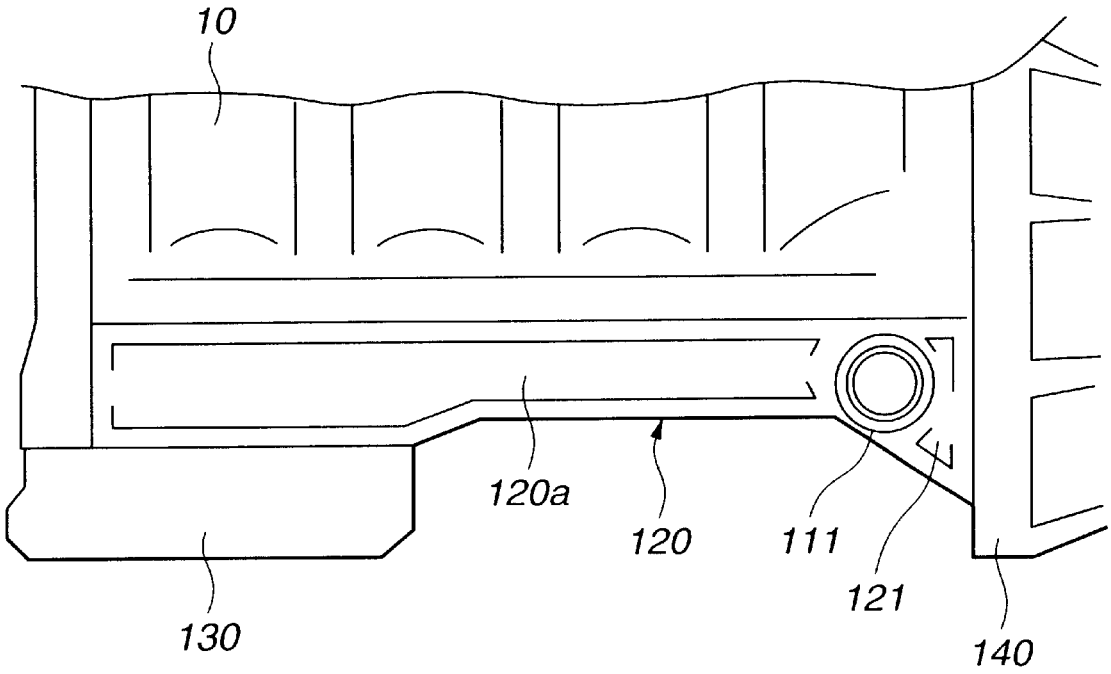
FIG. 31 is a partial side view of the engine of the eighth embodiment.

Referring to FIGS. 30 and 31, there is shown an internal combustion engine of an eighth embodiment of the present invention. Basic construction of this embodiment is substantially the same as that of the first embodiment. However, the bearing structure for the control shaft 90 is different from that of the first embodiment, which will be described in the following.

That is, as is seen from FIG. 30, to a flanged lower end of the skirt section 12 of the cylinder block 10, there is secured to a flanged upper end of an oil pan upper member 120. To a flanged lower end of the oil pan upper member 120, there is secured to a flanged upper end of an oil pan lower member 130. As is seen from FIG. 31, to a rear end of a side wall 120*a* of the oil pan upper member 120, there is secured a front portion of a transmission 140. For increased connection with the transmission 140, the rear end of the side wall 120*a* is formed with a gusseted portion 121. To a recessed part of the side wall 120*a* near the gusseted portion 121, there is mounted an electric motor 111 which drives the control shaft 90.

As is seen from FIG. 30, an output shaft 111*a* of the motor 111 is led into the crankcase through an opening of the side wall 120*a*. The output shaft 11*a* has at its leading end a worm 110 which is meshed with a worm wheel 109 secured to the control shaft 90. When the motor 111 is energized to run in a given direction for a given period by a control unit (not shown), the control shaft 90 is rotated in a given direction by a given angle. Since the motor 111 is arranged outside of the engine, the motor 111 is protected from the excessive heat generated in the engine. Lubrication of the worm 110 and worm wheel 109 is effected by the engine oil flowing in the engine. Since the motor 111 is mounted to the recessed part of the side wall 120*a* of the oil pan upper member 120, the entire size of the engine is not so largely affected by the provision of the motor 111.

Figure 32:
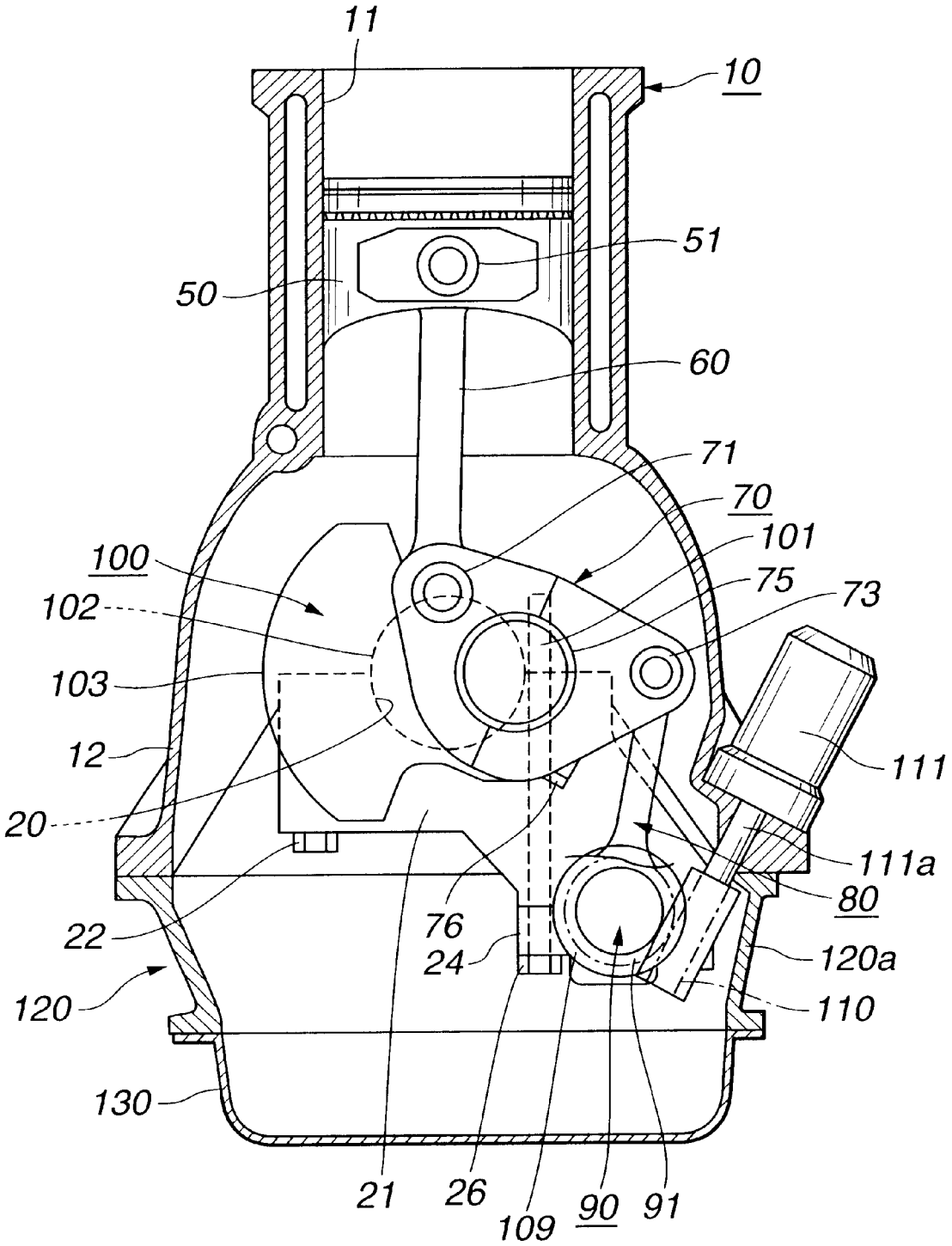
FIG. 32 is a view similar to FIG. 1, but showing a ninth embodiment of the present invention.
Figure 33:
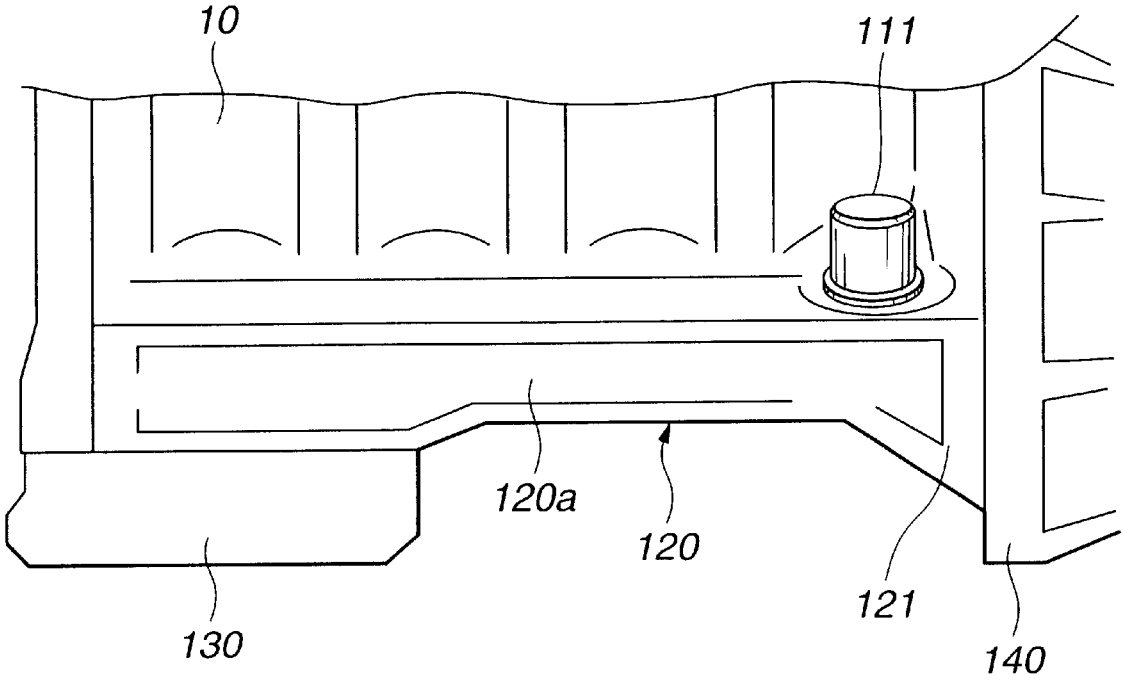
FIG. 33 is a partial side view of the engine of the ninth embodiment.

Referring to FIGS. 32 and 33, there is shown an internal combustion engine of a ninth embodiment of the present invention.

The ninth embodiment is substantially the same as the above-mentioned eighth embodiment except for the arrangement of the motor 111. That is, as is seen from FIG. 32, the motor 111 is diagonally connected to a lower portion of the skirt section 12 of the cylinder block 10. That is, an output shaft 111*a* of the motor 111 extends along a side wall 120*a* of the oil pan upper member 120. Due to the inclined arrangement of the motor 111 relative to the engine, the entire size of the engine is not so largely affected by the provision of the motor 111.

Figure 34:
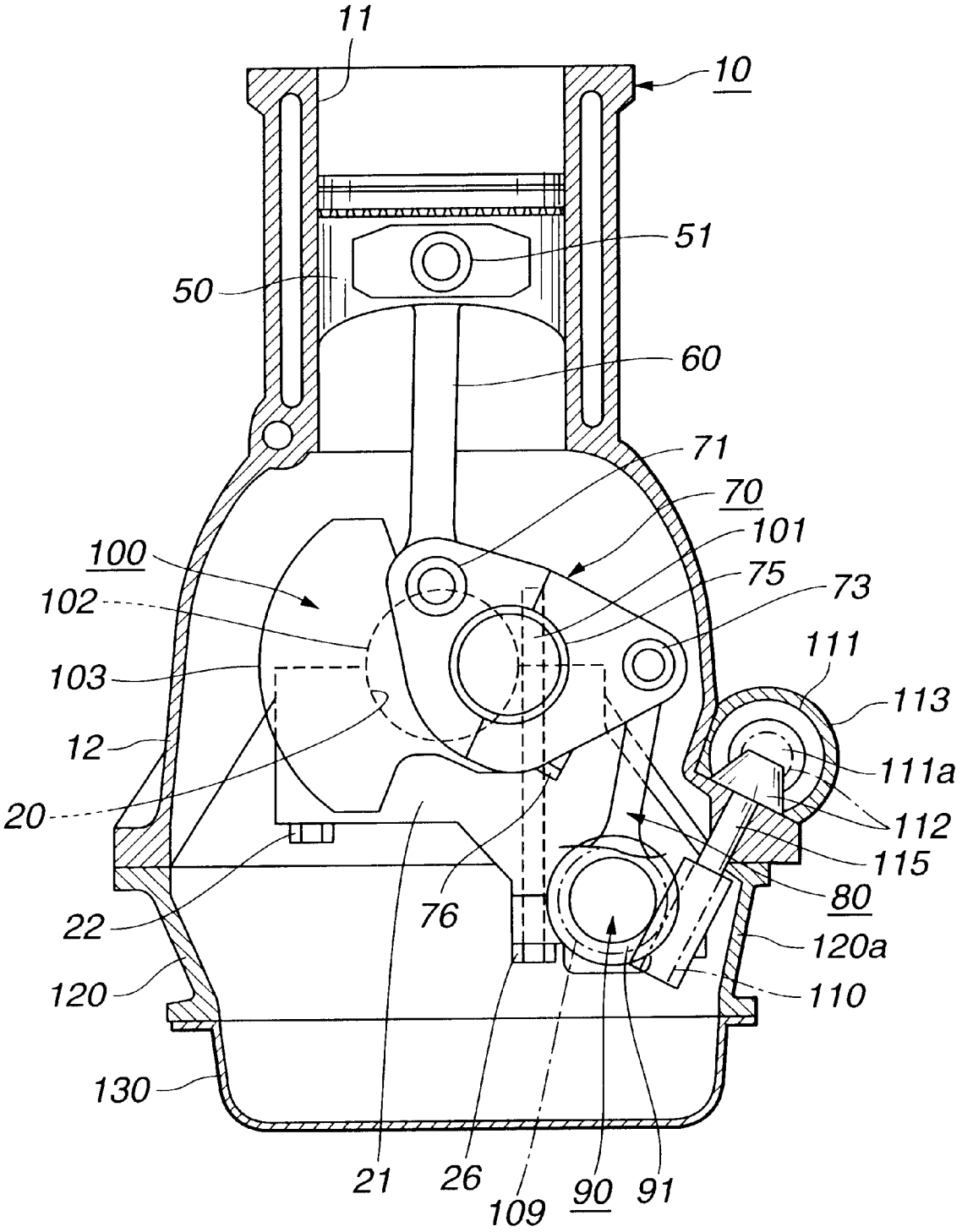
FIG. 34 is a view similar to FIG. 1, but showing a tenth embodiment of the present invention.
Figure 35:
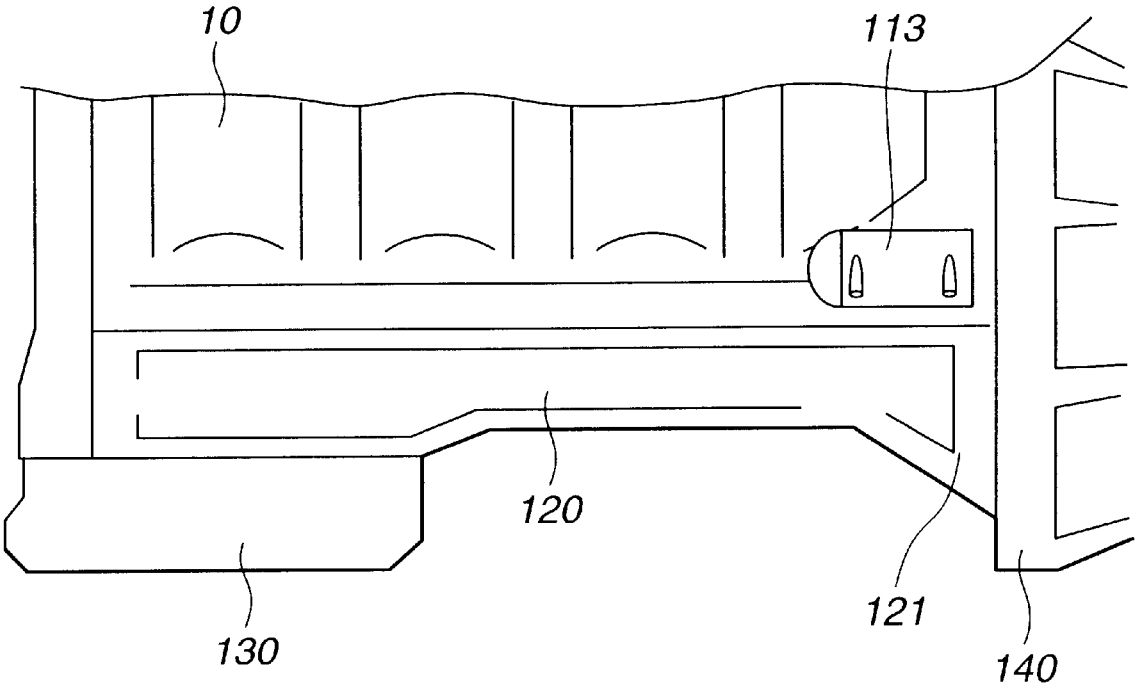
FIG. 35 is a partial side view of the engine of the tenth embodiment.

Referring to FIGS. 34 and 35, there is shown an internal combustion engine of a tenth embodiment of the present invention.

The tenth embodiment is substantially the same as the above-mentioned ninth embodiment except for the arrangement of the motor 111. That is, as is seen from FIG. 34, the motor 111 is laid down relative to the engine. More specifically, the motor 111 is connected through a bracket 113 to a lower end portion of the skirt section 12 of the cylinder block 10 in such a manner that a longitudinal axis of the motor 111 extends generally in parallel with a rotation axis of the countershaft 100. An output shaft 111*a* of the motor 111 and an auxiliary shaft 115 are connected through a pair of bevel gears 112. The auxiliary shaft 115 extends along the side wall 120*a* of the oil pan upper member 120 and has at its leading end the worm 110 meshed with worm wheel 109 of the control shaft 90. Due to the laid down arrangement of the motor 111, much compact construction of the engine is achieved.

Figure 36:
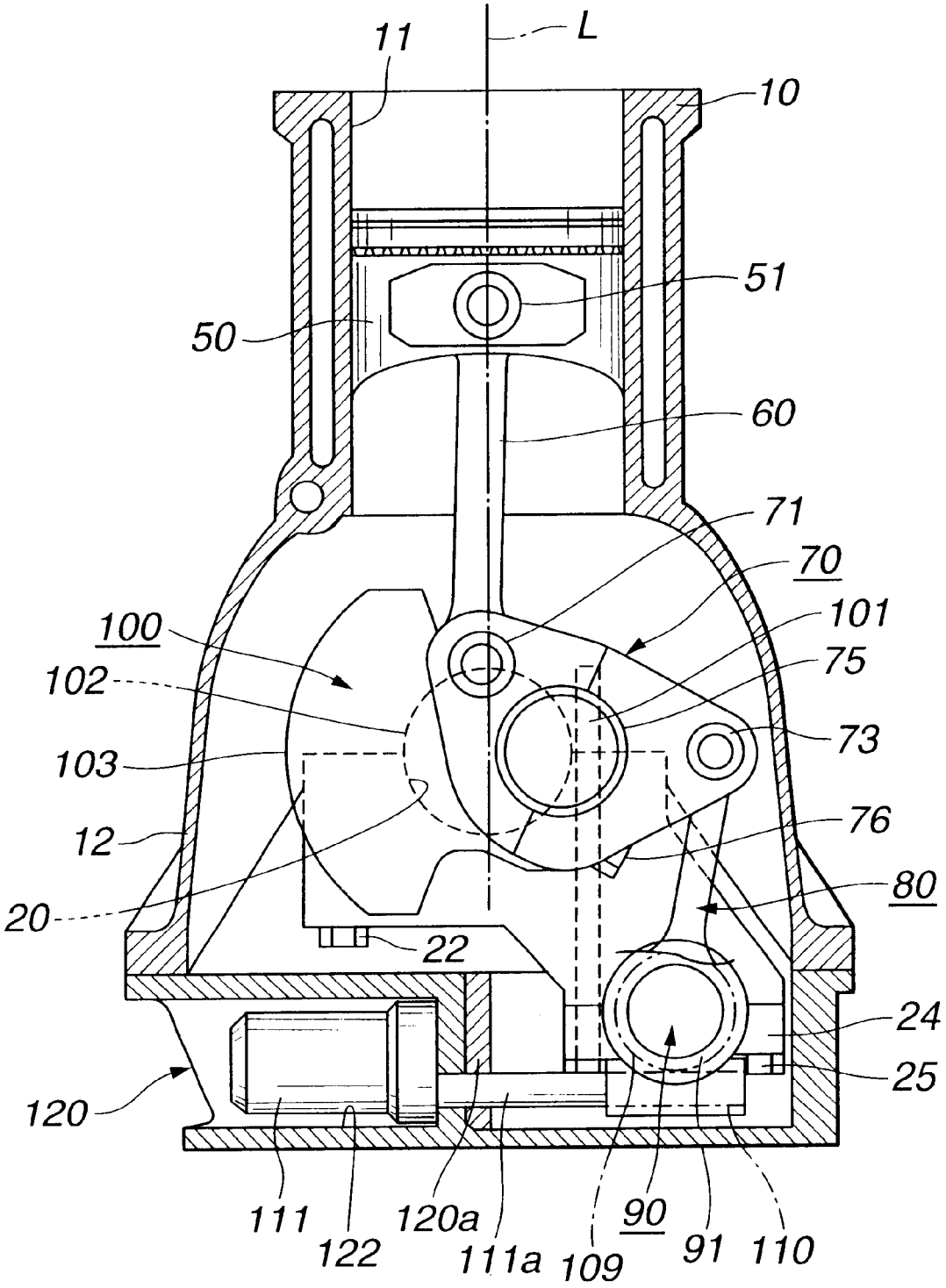
FIG. 36 is a view similar to FIG. 1, but showing an eleventh embodiment of the present invention.
Figure 37:
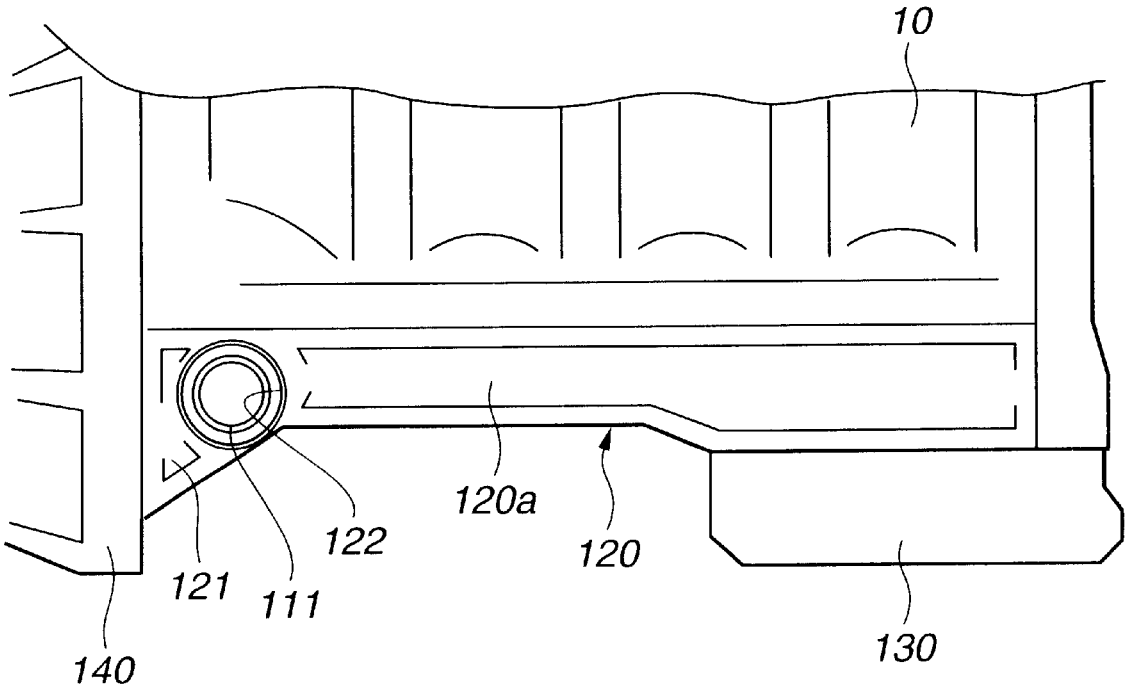
FIG. 37 is a partial side view of the engine of the eleventh embodiment.

Referring to FIGS. 36 and 37, there is shown an internal combustion engine of an eleventh embodiment of the present invention.

The eleventh embodiment is substantially the same as the above-mentioned eighth embodiment except for the arrangement of the motor 111. That is, as is seen from FIG. 36, the motor 111 is located at a position opposite to the control shaft 90 with respect to the reference line "L". The motor 111 is entirely put in a mounting recess 122 formed in the oil pan upper member 120. The output shaft 111*a* from the motor 111 extends through the side wall 120*a* of the oil pan upper member 120. The leading end of the output shaft 111*a* has the worm 110 meshed with the worm wheel 109 of the control shaft 90, as shown. Because the motor 111 is positioned below the engine, provision of the motor 111 does not induce a lateral expansion of the entire construction of the engine.

Figure 38:
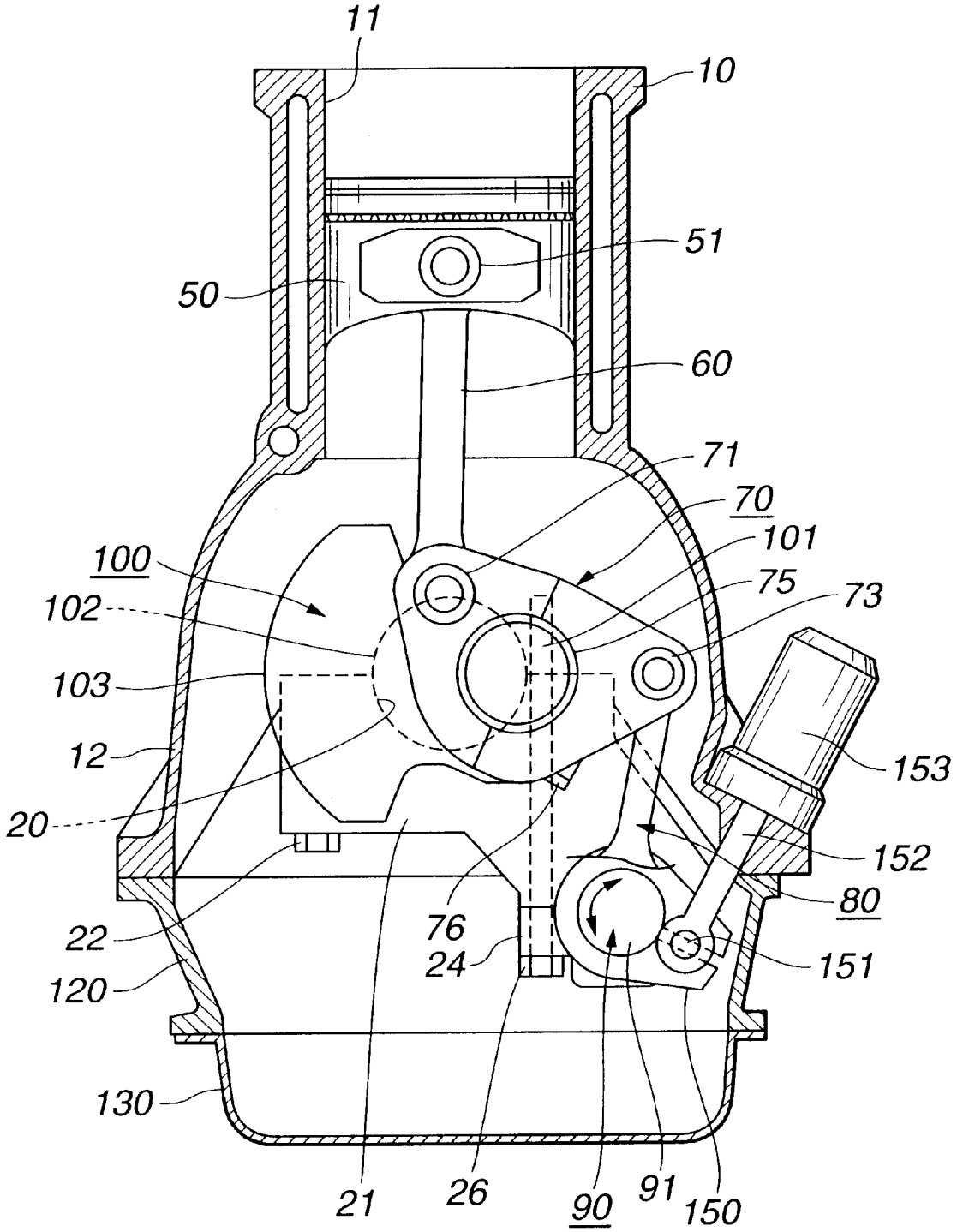
FIG. 38 is a view similar to FIG. 1, but showing a twelfth embodiment of the present invention.
Figure 39:
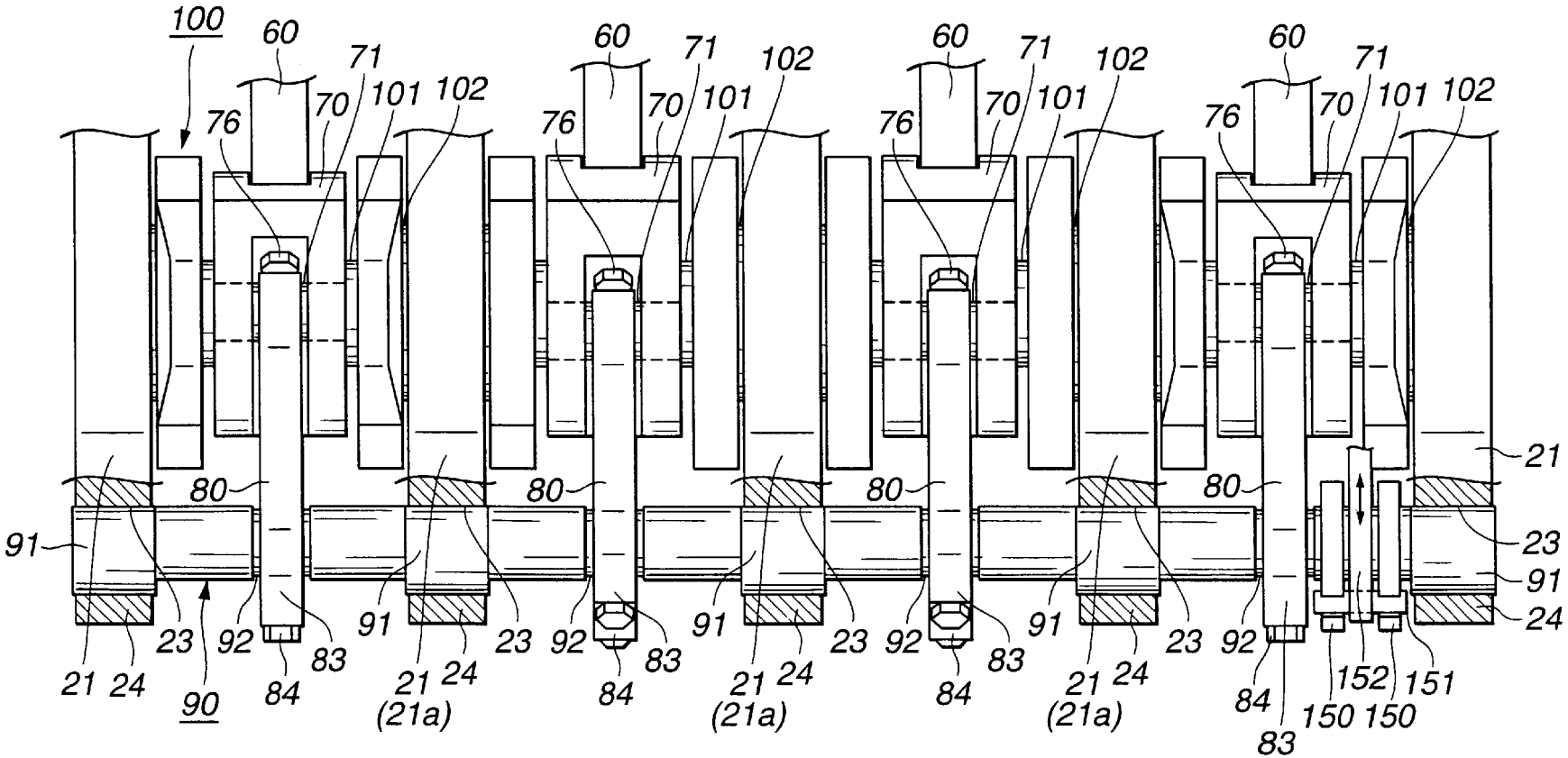
FIG. 39 is a view similar to FIG. 2, but showing the variable compression ratio mechanism associated with the twelfth embodiment.
Figure 40:
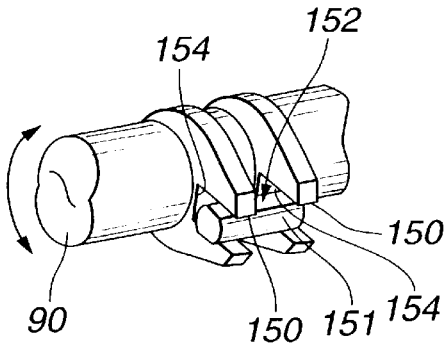
FIG. 40 is a perspective view of a transmission unit mounted to a control shaft of the variable compression ratio mechanism associated with the twelfth embodiment.

Referring to FIGS. 38 to 40, there is shown an internal combustion engine of a twelfth embodiment of the present invention.

The twelfth embodiment is substantially the same as the above-mentioned ninth embodiment except for the arrangement of the motor. As is seen from FIG. 38, in the twelfth embodiment, the motor 153 employs an axially moving rod 152 as an output means. The leading end of the rod 152 has a pin 151 fixed thereto. While, as is seen from FIG. 40, a pair of fork members 150 are fixed to the control shaft 90. As is seen from FIGS. 38 and 40, the pin 151 is slidably engaged with aligned slits 154 formed in the fork members 150. Thus, when, upon energization of the motor 153, the rod 152 moves axially to a certain position, the control shaft 90 is rotated about its axis to a corresponding angular position.

Figure 41:
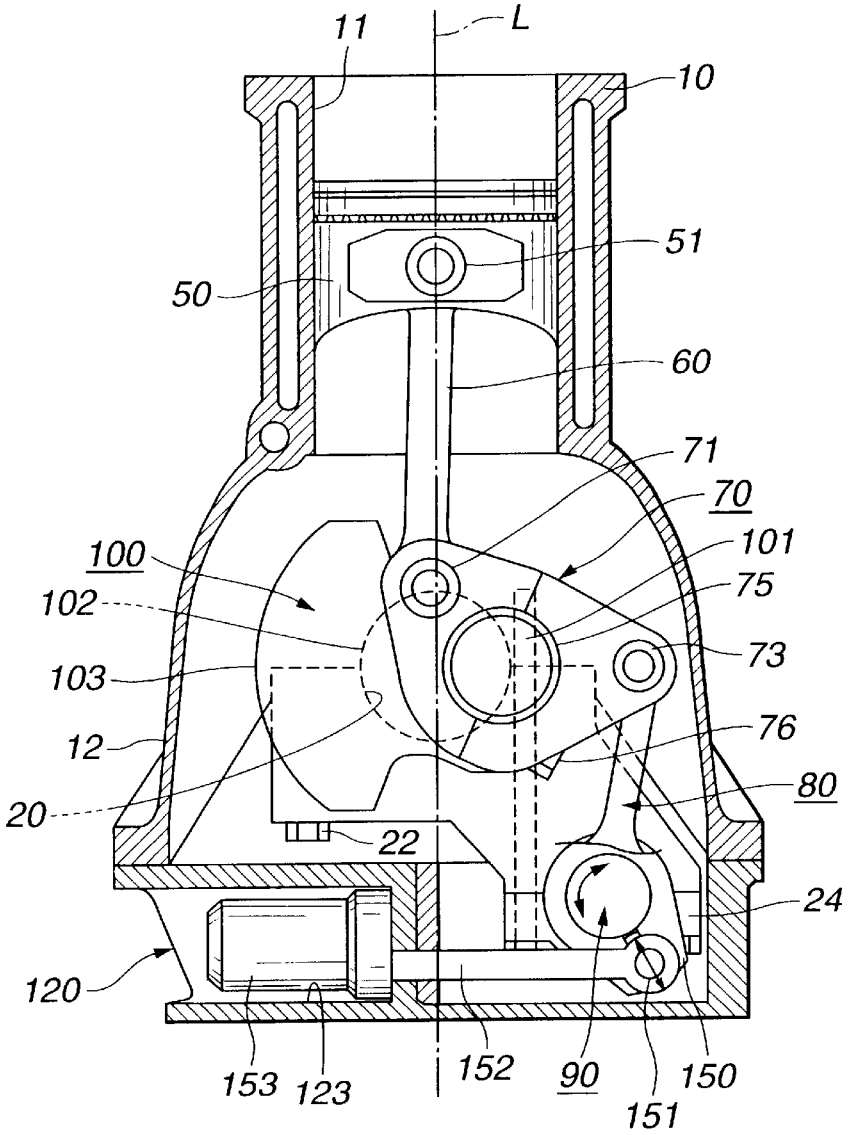
FIG. 41 is a view similar to FIG. 1, but showing a thirteenth embodiment of the present invention.

Referring to FIG. 41, there is shown an internal combustion engine of a thirteenth embodiment of the present invention.

The thirteenth embodiment is substantially the same as the above-mentioned twelfth embodiment except for the arrangement of the motor 153. That is, like in the above-mentioned eleventh embodiment, the motor 153 is located at a position opposite to the control shaft 90 with respect to the reference line "L". The motor 153 is entirely put in a mounting recess 123 formed in the oil pan upper member 120. The axially moving rod 152 from the motor 153 passes through a side wall of the oil pan upper member 120 and is operatively engaged with the control shaft 90 through the pin 151 and the fork members 150 in the same manner as that in the twelfth embodiment.

The entire contents of Japanese Patent Application 2000-230232 (filed Jul. 31, 2000) are incorporated herein by reference.

Although the invention has been described above with reference to embodiments of the invention, the invention is not limited to such embodiments. Various modifications and variations of the embodiments will occur to those skilled in the art, in light of the above teachings.

What is claimed is:

1. An internal combustion engine comprising:

a cylinder block having a cylinder in which a piston reciprocates;

a crankshaft rotatably installed in said cylinder block, said crankshaft including a crank pin and a counter-weight; and a variable compression ratio mechanism including an upper link having one end pivotally connected to a piston pin of said piston, a lower link pivotally disposed on said crank pin of said crankshaft and having one part pivotally connected to the other end of said upper link, a control shaft extending substantially in parallel with said crankshaft, a control link having a first end pivotally connected to the other part of said lower link and an eccentric bearing structure through which a second end of said control link is connected to said control shaft, so that rotation of said control shaft about its axis induces a pivoting of said lower link about said crank pin thereby varying the stroke of the piston, in which said variable compression ratio mechanism is so arranged that, when viewed in an axial direction of said crankshaft, said first end of said control link assumes the same side as a rotation axis of said control shaft with respect to an imaginary reference line and assumes a most remote position from said imaginary reference line, the rotation axis of said control shaft is positioned outside of a circle described by the periphery of said counter-weight and positioned nearer to said imaginary reference line than said most remote position is, said imaginary reference line being a line which extends along an axis of said cylinder through a rotation axis of said crankshaft, and wherein the control shaft is disposed to the lower side of the crankshaft.

2. An internal combustion engine as claimed in claim 1, further comprising:

first bearing caps which are to be connected to said cylinder block to rotatably hold said crankshaft, said first bearing caps being juxtaposed in the axial direction of said crankshaft;

second bearing caps which are to be connected to said first bearing caps to rotatably hold said control shaft, said second bearing caps being juxtaposed in the axial direction of said crankshaft; and connecting bolts which connect said first bearing caps to said cylinder block, a given number of said connecting bolts being used for connecting said second bearing caps to said first bearing caps.

3. An internal combustion engine as claimed in claim 1, further comprising first bearing caps which are connected to said cylinder block to rotatably hold said crankshaft, each of said first bearing caps having a bearing portion in the shape of circular opening for rotatably holding said control shaft.

4. An internal combustion engine as claimed in claim 1, further comprising:

first bearing caps which are to be connected to said cylinder block to rotatably hold said crankshaft, said first bearing caps being juxtaposed in the axial direction of said crankshaft;

a bearing beam including a plurality of branch plate portions which are respectively connected to said first bearing caps and an elongate base plate portion which connects said branch plate portions integrally, said elongate base plate portion extending along the axis of said crankshaft;

second bearing caps which are to be connected to the branch plate portions of said bearing beam to rotatably hold said control shaft; and connecting bolts which connect said branch plate portions of said bearing beam to said first bearing caps, a given number of said connecting bolts being used for connecting said second bearing caps to said branch plate portions of said bearing beam.

5. An internal combustion engine as claimed in claim 1, further comprising:

first bearing caps which are connected to said cylinder block to rotatably hold said crankshaft, said first bearing caps being juxtaposed in an axial direction of said crankshaft; and a bearing beam including a plurality of branch plate portions which are respectively connected to said first bearing caps and an elongate base plate portion which connects said branch plate portions integrally, said elongate base plate portion extending along the axis of said crankshaft, each of said branch plate portions having a bearing portion in the shape of circular opening for rotatably holding said control shaft.

6. An internal combustion engine as claimed in claim 1, further comprising:

first bearing caps which are connected to said cylinder block to rotatably hold said crankshaft, said first bearing caps being juxtaposed in an axial direction of said crankshaft; and a plurality of supporting blocks which are respectively connected to said first bearing caps, each of said supporting blocks having a bearing portion in the shape of circular opening for rotatably holding said control shaft.

7. An internal combustion engine as claimed in claim 1, further comprising:

a ladder frame integrally connected to said cylinder block, said ladder frame including first bearing caps which are juxtaposed in an axial direction of the crankshaft to rotatably hold said crankshaft, and two opposed wall portions between which said bearing caps extend;

second bearing caps which are to be connected to said first bearing caps to rotatably hold said control shaft; and connecting bolts which connect said first bearing caps to said cylinder block, a given number of the connecting bolts being used for connecting said second bearing caps to said first bearing caps.

8. An internal combustion engine as claimed in claim 1, further comprising a ladder frame integrally connected to said cylinder block, said ladder frame including first bearing caps which are juxtaposed in an axial direction of the crankshaft to rotatably hold said crankshaft, and two opposed wall portions between which said first bearing caps extend, each of said first bearing caps having a bearing portion in the shape of circular opening for rotatably holding said control shaft.

9. An internal combustion engine as claimed in claim 1, further comprising:

an electric motor mounted to a side wall of the engine to actuate said control shaft; and an output shaft extending from said electric motor into the interior of the cylinder block and connected to said control shaft.

10. An internal combustion engine as claimed in claim 9, in which said output shaft extends substantially perpendicular to the axis of said control shaft.

11. An internal combustion engine as claimed in claim 9, in which said output shaft extends substantially in parallel with said side wall of said engine.

12. An internal combustion engine as claimed in claim 9, in which said motor is so arranged that an axis of said motor extends substantially in parallel with the axis of said crankshaft.

13. An internal combustion engine as claimed in claim 9, in which said side wall of said engine is formed, at a portion to which a part of a transmission is connected, with a gusseted portion to which said electric motor is mounted.

14. An internal combustion engine as claimed in claim 9, in which the side wall of the engine is formed, at a side opposite to said control shaft with respect to the imaginary reference line when viewed in the axial direction of the crankshaft, with a mounting recess to mount therein said electric motor.

15. An internal combustion engine as claimed in claim 9, in which said output shaft is of a type which rotates about its axis, and in which said output shaft is connected to said control shaft through a transmission unit which comprises a worm fixed to said output shaft and a worm wheel fixed to said control shaft.

16. An internal combustion engine as claimed in claim 9, in which said output shaft is of a type which axially moves, and in which said output shaft is connected to said control shaft through a transmission unit which comprises a pin fixed to said output shaft and a fork member fixed to said control shaft, said fork member having a radially extending slit with which said pin is slidably engaged.

17. An internal combustion engine as claimed in claim 2, in which each of said given number of the connecting bolts is positioned between said imaginary reference line and a control shaft bearing member which rotatably holds said control shaft.

18. An internal combustion engine as claimed in claim 17, in which a main journal of said control shaft, which is actually rotatably held by the control shaft bearing member, is formed with a semi-circular groove for avoiding interference with the connecting bolt.

19. An internal combustion engine as claimed in claim 1, in which said lower link has a split structure to facilitate the work for assembling the lower link to the crank pin of said crankshaft.

20. An internal combustion engine as claimed in claim 1, in which said lower link has a generally triangular shape, the triangular lower link having at a generally middle portion a circular opening through which said crank pin passes, and in which the parts of said lower link are corners possessed by the triangular lower link.

21. An internal combustion engine as claimed in claim 1, in which said eccentric bearing structure of said variable compression ratio mechanism comprises:

an annular groove formed around said control shaft, said annular groove being eccentric to a rotation axis of said control shaft; and a circular opening formed in an enlarged lower end of said control link, said circular opening being rotatably mated with said annular groove.

22. An internal combustion engine as claimed in claim 1, further comprising:

a ladder frame integrally connected to said cylinder block, said ladder frame including first bearing caps which are juxtaposed in an axial direction of the crankshaft to rotatably hold said crankshaft, and two opposed wall portions between which said bearing caps extend;

second bearing caps which are to be connected to said first bearing caps to rotatably hold said control shaft; and connecting bolts which connect said first bearing caps to said cylinder block, a given number of the connecting bolts being used for connecting said second bearing caps to said first bearing caps.

23. An internal combustion engine comprising:

a cylinder block having a cylinder in which a piston reciprocates;

a crankshaft rotatably installed in said cylinder block, said crankshaft including a crank pin and a counter-weight; and a variable compression ratio mechanism including an upper link having one end pivotally connected to a piston pin of said piston, a lower link pivotally disposed on said crank pin of said crankshaft and having one part pivotally connected to the other end of said upper link, a control shaft extending substantially in parallel with said crankshaft, a control link having a first end pivotally connected to the other part of said lower link and an eccentric bearing structure through which a second end of said control link is connected to said control shaft, so that rotation of said control shaft about its axis induces a pivoting of said lower link about said crank pin thereby varying the stroke of the piston, and wherein the control shaft is disposed to the lower side of the crankshaft.

* * * * *